US010243296B2

(12) United States Patent
Cheng

(10) Patent No.: US 10,243,296 B2
(45) Date of Patent: Mar. 26, 2019

(54) SAFETY SOCKET WITH MEANS TO PREVENT ELECTRIC SHOCK AND ELECTRICAL DISCHARGE

(71) Applicants: Chen-Yuan Cheng, Keelung (TW); HUNG SHANG CO., LTD, Taipei (TW)

(72) Inventor: Chen-Yuan Cheng, Keelung (TW)

(73) Assignees: Chen-Yuan Cheng, Keelung (TW); Hung Shang Co., Ltd., Taipei (TW)

( * ) Notice: Subject to any disclaimer, the term of this patent is extended or adjusted under 35 U.S.C. 154(b) by 0 days.

(21) Appl. No.: 15/855,696

(22) Filed: Dec. 27, 2017

(65) Prior Publication Data

US 2018/0198229 A1 Jul. 12, 2018

(30) Foreign Application Priority Data

Jan. 6, 2017 (TW) ..... 106100472 A

(51) Int. Cl.

| | |
|---|---|
| ***H01R 13/70*** | (2006.01) |
| ***H01R 13/53*** | (2006.01) |
| ***H01R 13/703*** | (2006.01) |
| ***H01R 13/18*** | (2006.01) |
| *H01R 24/20* | (2011.01) |

(Continued)

(52) U.S. Cl.

CPC ..... *H01R 13/53* (2013.01); *H01R 13/18* (2013.01); *H01R 13/703* (2013.01); *H01R 13/112* (2013.01); *H01R 13/447* (2013.01); *H01R 13/453* (2013.01); *H01R 13/4532* (2013.01); *H01R 13/4534* (2013.01); *H01R 13/4536* (2013.01); *H01R 13/4538* (2013.01); *H01R 13/6485* (2013.01); *H01R 13/70* (2013.01); *H01R 13/7031* (2013.01); *H01R 13/7039* (2013.01); *H01R 13/713* (2013.01);

(Continued)

(58) Field of Classification Search

CPC .. H01R 13/70; H01R 13/703; H01R 13/7039; H01R 13/713; H01R 24/46; H01R 13/6485; H01R 13/453; H01R 13/4532; H01R 13/4534; H01R 13/447; H01R 13/4538; H01R 13/4536

USPC ..... 439/88, 181, 188, 135, 137, 138, 139, 439/140, 143

See application file for complete search history.

(56) References Cited

U.S. PATENT DOCUMENTS 7,931,482 B2 4/2011 Liao
8,297,996 B2 * 10/2012 Chuang ..... H01R 13/7032 439/188

* cited by examiner

*Primary Examiner* — Abdullah A Riyami
*Assistant Examiner* — Justin M Kratt
(74) *Attorney, Agent, or Firm* — Muncy, Geissler, Olds & Lowe, P.C.

(57) ABSTRACT

A safety socket includes a main body, a first and second conductive seat, a first and second electric connection plates, a first and second insulated member and a first and second conductive plates. A first and second position block projects outwardly from first and second chambers of the main body. The first conductive seat includes a first clamp couch having two first clamp arms, one of which is formed with a first recess permitting extension of the first position block. The second conductive seat includes a second clamp couch having two second arms, one of which is formed with a second recess permitting extension of the second position block. The present safety socket has lesser components, easy to assemble and low in manufacturing cost, double safety measures. Addition of a switch device enhances the anti- (Continued)

shock effect and prevents occurrence of electrical discharge phenomenon and/or arc light phenomenon.

11 Claims, 22 Drawing Sheets

(51) Int. Cl.

| | |
|---|---|
| *H01R 103/00* | (2006.01) |
| *H01R 13/713* | (2006.01) |
| *H01R 24/46* | (2011.01) |
| *H01R 13/648* | (2006.01) |
| *H01R 13/453* | (2006.01) |
| *H01R 13/447* | (2006.01) |
| *H01R 13/11* | (2006.01) |

(52) U.S. Cl.
CPC ..... *H01R 24/20* (2013.01); *H01R 24/46* (2013.01); *H01R 2103/00* (2013.01)

SAFETY SOCKET WITH MEANS TO PREVENT ELECTRIC SHOCK AND ELECTRICAL DISCHARGE

CROSS-REFERENCE TO RELATED APPLICATION

This application claims the priority of Taiwanese patent application No. 106100472, filed on Jan. 6, 2017, which is incorporated herewith by reference.

BACKGROUND OF THE INVENTION

1. Field of the Invention

The present invention generally relates to a socket structure, and more particular to a safety socket which can prevent electric shock when inserted with foreign objects of a non plug unit having a conductive property.

2. The Prior Arts

Wall sockets are provided to facilitate insertion of a plug unit of a consumer's electronic device for charging the same in case the electronic device has run out of power. A conventional socket jack is not provided with a safety precaution so that some people who do not have common sense of electricity, such as children, holding a metal rod or wire and other non-conductive foreign objects inserted into the socket jack may cause electrocution.

Multiple types of safety sockets are available in the market to solve the abovementioned drawbacks, like U.S. Pat. Nos. 8,297,996 and 7,931,482. The presently existing safety sockets are designed in complicated ways and have many components, thereby resulting in long assembling time, high manufacturing expense, easy damage and inconvenience in use.

Moreover, since the socket jacks of the conventional safety socket are mostly exposed to the atmosphere, electrical discharge phenomenon may occur at the time the plug is inserted into the socket jack, and/or arc light phenomenon may occur at the time the plug is removed from the socket jack.

SUMMARY OF THE INVENTION

A primary objective of the present invention is to provide a safety socket, which has the advantages, like lesser components, easy to assemble and low in manufacturing cost, and which itself can prevent electric shock when inserted with foreign objects of a non plug unit having the conductive property.

Another objective of the present invention is to provide a safety socket, which has double safety measures so as to prevent from electric shock and thus promote safety.

Yet another objective of the present invention is to provide a safety socket, which can prevent occurrence of electrical discharge phenomenon and/or arc light phenomenon the moments the plug is inserted into or removed from the socket jack of the safety socket of the present invention.

In order to achieve the above-mentioned objective, the present invention provides a safety socket including: a main body, a first conductive seat, a second conductive seat, a first electric connection plate, a second electric connection plate, a first insulated member, a second insulate member, a first conductive plate and a second conductive plate.

The main body includes a cover body, a bottom seat and a mounting seat. The cover body is formed with first and second plug holes and is mounted detachably on the bottom seat to define a reception space therebetween to receive the mounting seat consisting of a first chamber and a second chamber, a first position block projecting from a junction adjoining a bottom part of the first chamber and an inner side wall of a side of the first chamber adjacent to the second chamber, a second position block projecting from a junction adjoining a bottom part of the second chamber and an inner side wall of a side of the second chamber adjacent to an the first chamber.

The first conductive seat is disposed in the first chamber of the mounting seat so as to be located below the first plug hole in the cover body, includes: a first clamp couch and two first pivot elements, the first clamp couch including a bottom part having first and second sides in the width direction and first and second ends in the length direction and two first clamp arms integrally from with an upper end of the bottom part adjacent to the first and second ends respectively. The first side of the bottom part is formed with a first recess to permit extension of the first position block while the two first pivot elements are mounted pivotally on the bottom part of the first clamp couch adjacent to the first and second ends and having two exterior side faces away from the first clamp couch and each is formed with a contact point.

The second conductive seat is disposed in the second chamber of the mounting seat so as to be located below the second plug hole in the cover body, includes: a second clamp couch and two second pivot elements, the second clamp couch including a bottom part having first and second sides in the width direction and first and second ends in the length direction and two second clamp arms integrally formed with an upper end of the bottom part adjacent to the first and second ends respectively. The first side of the bottom part is formed with a second recess to permit extension of the second position block while the two second pivot elements are mounted pivotally on the bottom part of the second clamp couch adjacent to the first and second ends and having two exterior side faces away from the second clamp couch and each is formed with a contact point.

The first electric connection plate is disposed on the mounting seat for coupling with a first wire and has a contact point.

The second electric connection plate is disposed in the mounting seat for coupling with a second wire and has a contact point.

The first insulated member is disposed between the first electric connection plate and one of the first pivot elements.

The second insulated member is disposed between the second electric connection plate and one of the second pivot elements.

The first conductive plate has a first end extending into the first chamber so as to be located between the first electric connection plate and the first insulated member, spacing apart from the first electric connection plate by a distance and having a contact point oriented toward the first electric connection plate and a second end extending into the second chamber so as to be located at one side of and spacing apart from the other one of the second pivot element by a distance, and having a contact point oriented toward the other one of the second pivot element.

The second conductive plate has first and second ends spaced apart from the first conductive plate, the first end of the second conductive plate extending into the second chamber so as to be located between the second electric connection plate and the second insulated member, spacing from the second electric connection plate by a distance and having a contact point oriented toward the second electric connection plate, the second end of the second conductive plate extending into the first chamber so as to be located at one side and spacing apart from the remaining one of the first pivot elements by a distance, having a contact point oriented toward the remaining one of the first pivot elements.

Wherein, insertion of two terminals of the plug respectively into the first and second plug holes in the cover body results in spreading the two first clamp arms away from each other in order to clamp one of the two terminals therebetween, which, in turn, causes pivoting the two first pivot elements away from each other relative to the bottom part, where the contact point of one of the first pivot elements pushes the first insulated member, which simultaneously pushes the first electric connection plate such that the contact point of the first electric connection plate touches the contact point at the first end of the first conductive plate while the contact point of the remaining one of the first pivot elements touches with the contact point at the second end of the second conductive plate, and simultaneously causing pivoting the two second clamp arms away from each other in order to clamp the remaining one of the two terminals therebetween, which in turn, where the contact point of one of the second pivot elements pushes the second insulated member, which simultaneously pushes the second electric connection plate such that the contact point at the second electric connection plate touches with the contact point at the first end of the second conductive plate while the contact point of the remaining second pivot elements touches with the contact point at the second end of the second conductive plate, thereby establishing electrical connection among the first and second electric connection plates, the first and second conductive plates, the remaining one of the first pivot elements, the remaining one of the second pivot elements and the two terminals of the plug.

Wherein, removal of the two terminals of the plug respectively from the first and second plug holes in the cover body results in placing the two first and second pivot elements to their initial positions, and simultaneously pushing the two first clamp arms and the two second clamp arms to their initial positions, thereby spacing the first and second electric connection plates, the first and second insulated members, the two first and second pivot elements and the first and second ends of the first and second conductive plates, thereby cutting off electrical connection there among.

Preferably, the bottom part of the first clamp couch is formed with a pair of first through holes. The first clamp arms are located between the pair of first through holes. Each of the two first pivot elements has a bottom end from which a first hook extends into a respective of the first through holes and engaging the bottom part of the first clamp couch, thereby mounting the first pivot elements pivotally and detachably to the bottom part adjacent to the first and second ends respectively. The first conductive seat further includes a first spring having two opposite ends connected respectively to the first pivot elements; wherein, the bottom part of the second clamp couch is formed with a pair of second through holes. The second clamp arms are located between the pair of second through holes. Each of the two second pivot elements has a bottom end from which a second hook extends into a respective of the second through holes and engaging the bottom part of the second clamp couch, thereby mounting the second pivot elements pivotally and detachably to the bottom part adjacent to the first and second ends respectively. The second conductive seat further includes a second spring having two opposite ends connected respectively to the second pivot elements; wherein, spreading the two first pivot elements away from each other due to insertion of one of the of two terminals of the plug simultaneously results in pivoting of the two first pivot elements about the first hooks away from the bottom part, thereby causing stretching away of two ends of the first spring relative to each other, wherein, spreading the two second pivot elements away from each other due to insertion of the other one of the of two terminals of the plug simultaneously results in pivoting of the two second pivot elements about the second hooks away from the bottom part, thereby causing stretching away of two ends of the second spring relative to each other, and wherein, removal of the two terminals of the plug respectively from the first and second plug holes in the cover body results in placing the two first and second pivot elements to their initial positions by virtue of restoration forces of the first and second springs.

Preferably, the first chamber has a bottom surface formed with a pair of first recesses permitting extension of the first hooks of the first pivot elements once the first pivot elements are mounted pivotally into the first through holes in the bottom part of the first clamp couch. The second chamber has a bottom surface formed with a pair of second recesses permitting extension of the second hooks of the second pivot elements once the second pivot elements are mounted pivotally into the second through holes in the bottom part of the second clamp couch.

Preferably, the pairs of first and second recesses of the first and second chambers extend through a bottom part of the mounting seat in a through hole manner.

Preferably, the bottom surface of the first chamber is further dented to form with a pair of first channel extending in the width direction of the first chamber through the pair of pair of first recesses. Each of the first recesses has a width in the length direction of the first chamber greater than a width of each of the first guide channels in the length direction of the first chamber; wherein the bottom surface of the second chamber is further dented to form with a pair of second channels extending in the width direction of the second chamber through the pair of second recesses. Each of the second recesses has a width in the length direction of the second chamber greater than a width of the second channels in the length direction of the second chamber.

Preferably, each of the first pivot elements is an integral piece defining a first inner wall, a first outer wall and a first bent portion interconnecting bottoms of the first inner and outer walls, wherein the first inner wall is bent in a Z-shaped and is oriented toward the other one of the first pivot elements and has a first hanging ear extending from an upper end thereof. Two opposite ends of the first spring engaging the first hanging ears of the first pivot elements such that contact points of the first pivot elements are formed on one side surface of the first outer wall distal from the first inner wall; wherein, each of the second pivot elements is an integral piece defining a second inner wall, a second outer wall and a second bent portion interconnecting bottoms of the second inner and outer walls, wherein the second inner wall is bent in a Z-shaped and is oriented toward the one of the first pivot elements and has a second hanging ear extending from an upper end thereof. The opposite ends of the second spring engaging the second hanging ears such that contact points of the second pivot elements are formed on one side of the second outer wall distal from the second inner wall.

Preferably, the first chamber is formed with a pair of first guide channels distal from an inner side wall of the second chamber. The second chamber is formed with a pair of second guide channels distal from an inner side wall of the first chamber, a first protrusion projecting outwardly from an outer side of each of the two first clamp arms and extending slidably into a respective one of the first guide channels, a second protrusion projecting outwardly from an outer side of each of the two second clamp arms and extending slidably into a respective one of the second guide channels.

Preferably, the bottom seat has a bottom part formed with a first insert hole and a lateral side formed with a vertical first insert slot extending through its upper end thereof. The mounting seat has a bottom part formed with a second insert hole and a lateral side formed with a vertical second insert slot extending through its lower end thereof. The first electric connection plate has a first end formed with the contact point and is located within the first chamber and a second end extending through the second insert hole in the mounting seat, the first insert hole in the bottom seat for electrically connecting with the first wire. The first insulated member extending upward from a bottom side of the first chamber so as to be located between the first end of the first electric connection plate and the one of the first pivot elements. The second electric connection plate has a first end formed with the contact point and is located within the second chamber and a second end extending through the vertical second insert slot in the mounting seat, the vertical first insert slot in the bottom seat for electrically connecting with the second wire. The second insulated member extends upward from a bottom side of the second chamber so as to be located between the second end of the second electric connection plate and one of the second pivot elements.

Preferably, the mounting seat has a bottom part formed with two fixing posts. The first conductive plate has a connection portion interconnecting the first and second ends and formed with a positioning hole permitting extension of one of the fixing posts. The second conductive plate has a connection portion interconnecting the first and second ends and formed with a positioning hole permitting extension of another one of the fixing posts, wherein, the connection portion of the first conductive plate encircles around and is spaced apart from the connection portion of the second conductive plate.

Preferably, the cover body is formed with two through hole. The safety socket of the present invention further includes an On-and-Off switch device disposed on the mounting seat and having a plate member, a third spring disposed below the plate member and a bottom part of the mounting seat, a first switch and a second switch mounted on a top part of the plate member in such a manner to extend through the two through holes in the cover body, wherein, insertion of two terminals of the plug respectively into the first and second plug holes in the cover body results in causing downward movement of the first and second switches, which, in turn, causes movement of the plate member downward so as to compress the third spring such that the first and second switches respectively and electrically contact with the first and second conduction plates, thereby establishing electrical connection among the first and second electric connection plates, the first and second conductive plates, one of the first pivot elements and one of the second pivot elements, the first and second switches and the terminals of the plug; wherein, removal of the two terminals of the plug respectively from the first and second plug holes in the cover body results in upward movement of the plate member due to restoration force of the third spring, which, in turn, causes upward movement of the first and second switches and separating the first and second conductive plates such that the first and second electric connection plates, the first and second insulated members, the two first pivot elements, the two second pivot elements, the first and second ends of the first and second connective plates are disconnected electrically from the first and second switches.

Distinct from the prior art, some of the advantages of the present invention resides in that the safety socket consists of lesser components, easy to assemble and low in manufacturing cost, and which itself can prevent electric shock when inserted with foreign objects of a non plug unit having the conductive property. In addition, the safety socket of the present invention has double safety measures so as to prevent from electric shock and thus promote safety. Moreover, the safety socket of the present invention can prevent occurrence of electrical discharge phenomenon and/or arc light phenomenon the moments the plug is inserted into or removed from the socket jack.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

Figure 1:
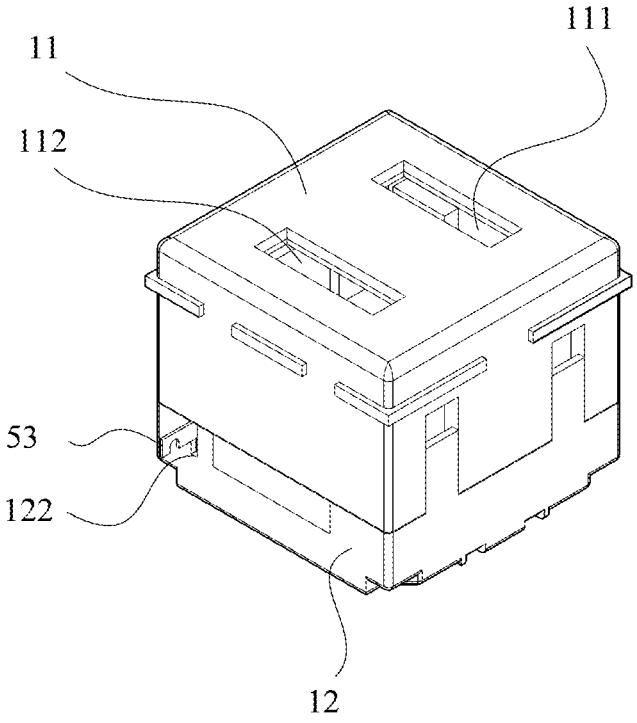
FIG. 1 is a perspective view showing a safety socket according to a first embodiment of the present invention.
Figure 2:
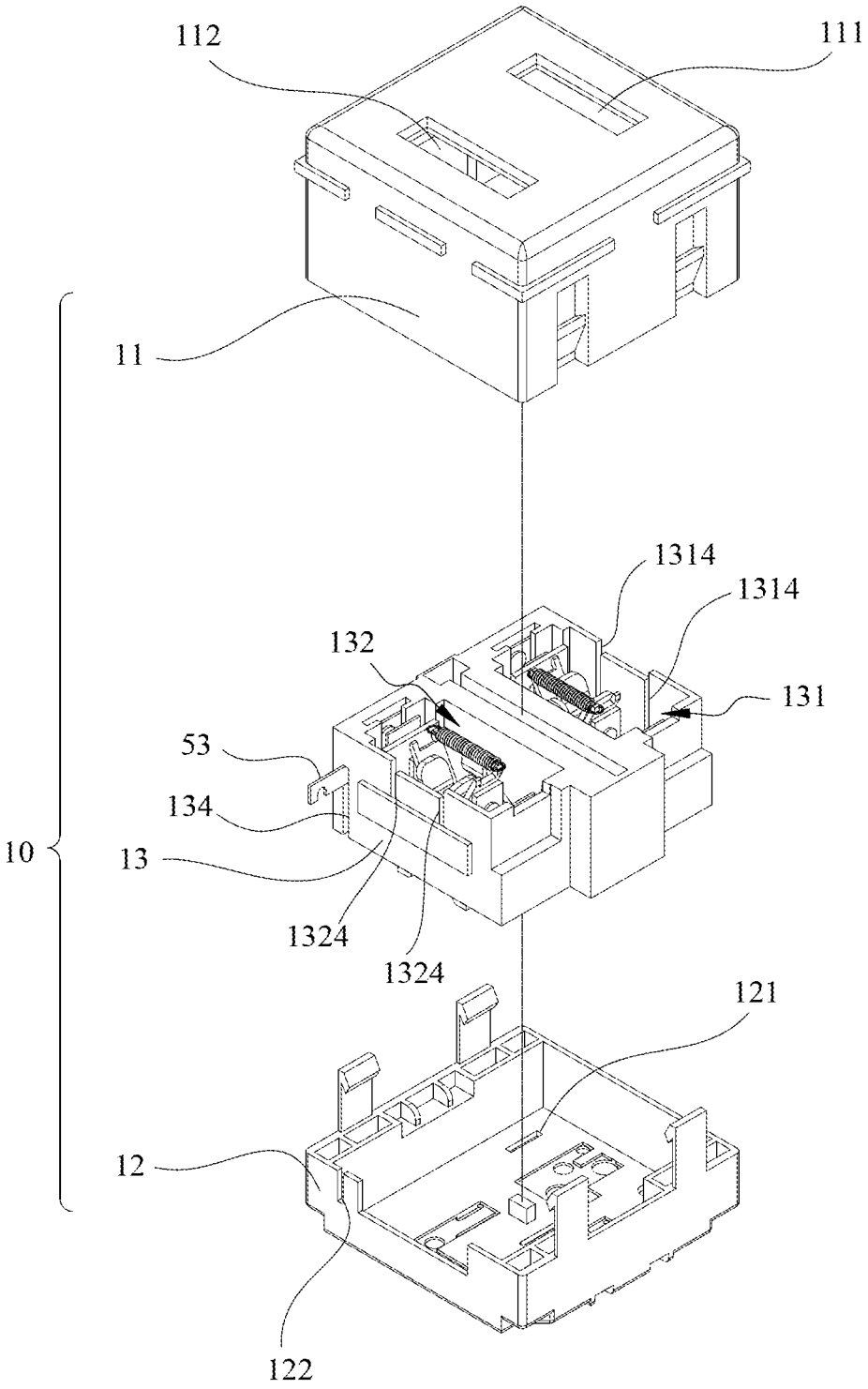
FIG. 2 is a perspective and exploded view showing the safety socket according to the first embodiment of the present invention.
Figure 3A:
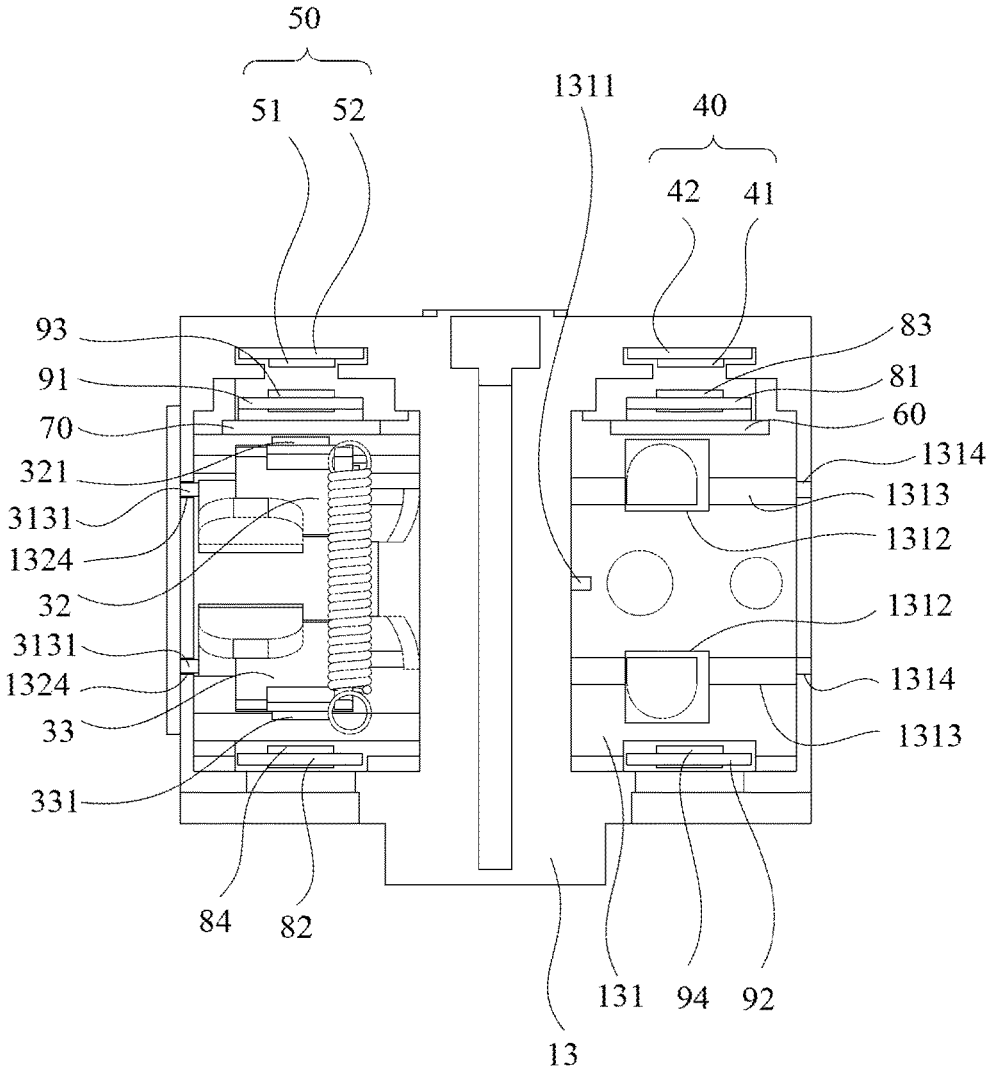
FIG. 3A is a top planer view showing a mounting seat of the safety socket according to the first embodiment of the present invention.
Figure 3B:
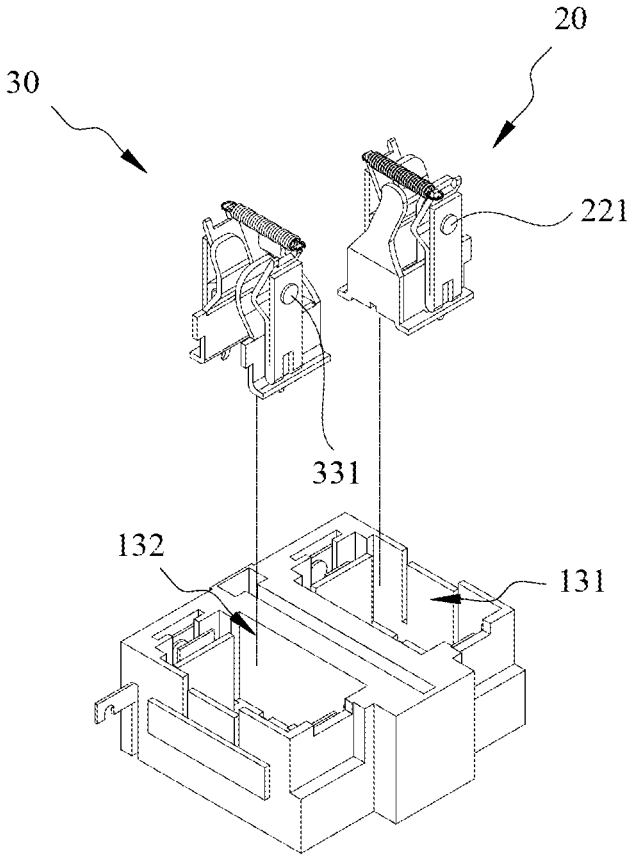
FIG. 3B is a perspective view showing first and second conductive seats together with the mounting seat of the safety socket according to the first embodiment of the present invention.
Figure 3C:
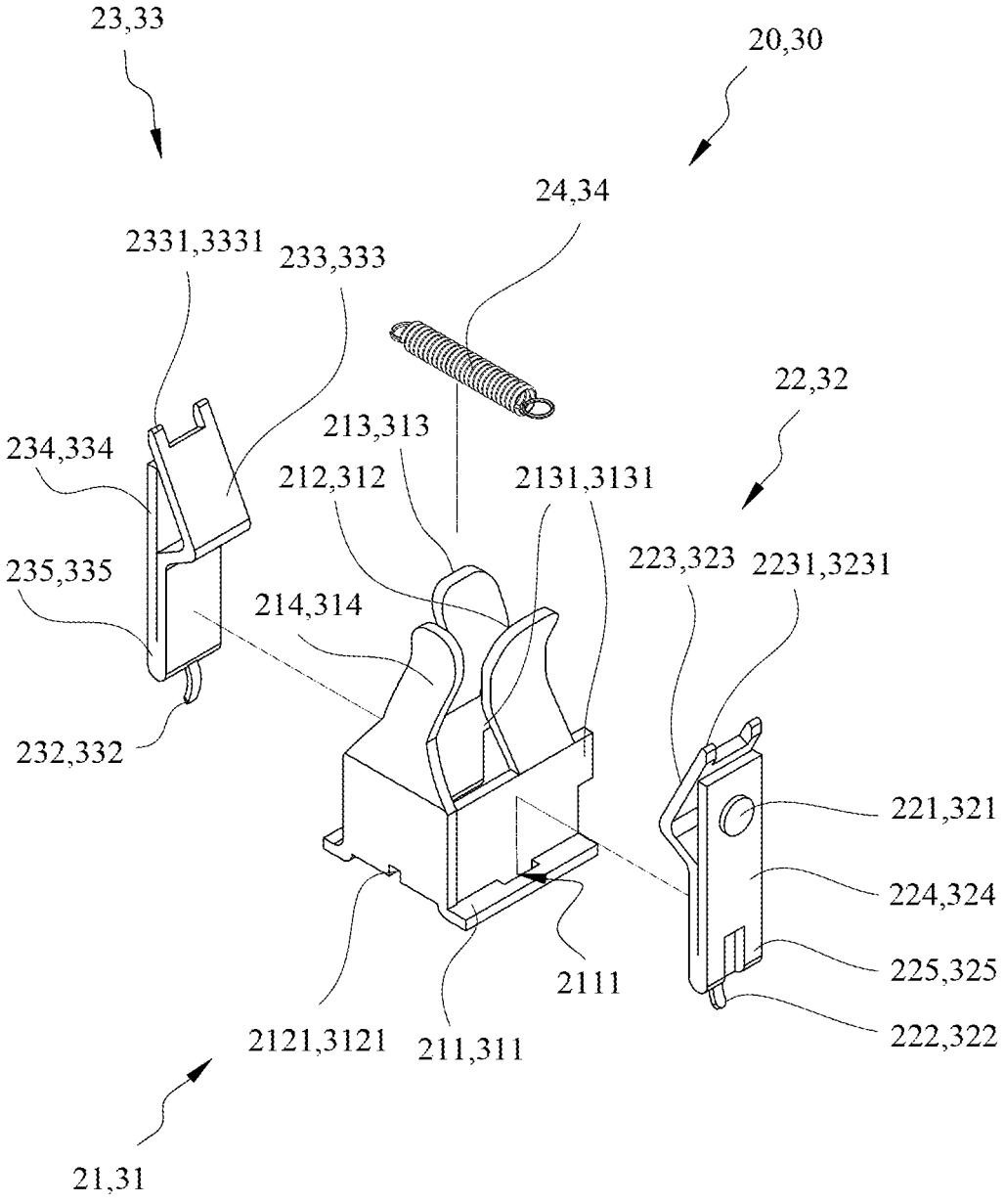
FIG. 3C is an exploded view of the first and second conductive seats in the safety socket according to the first embodiment of the present invention.
Figure 4A:
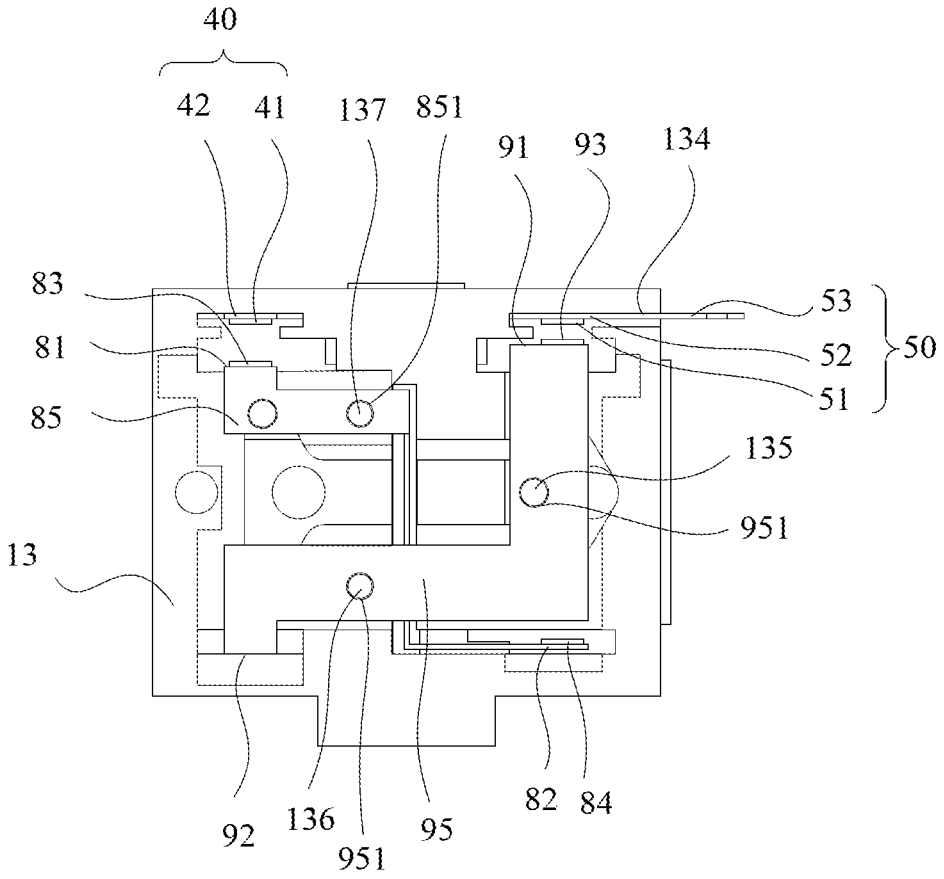
FIG. 4A is a bottom view, illustrating interior of the mounting seat of the safety socket according to the first embodiment of the present invention.
Figure 4B:
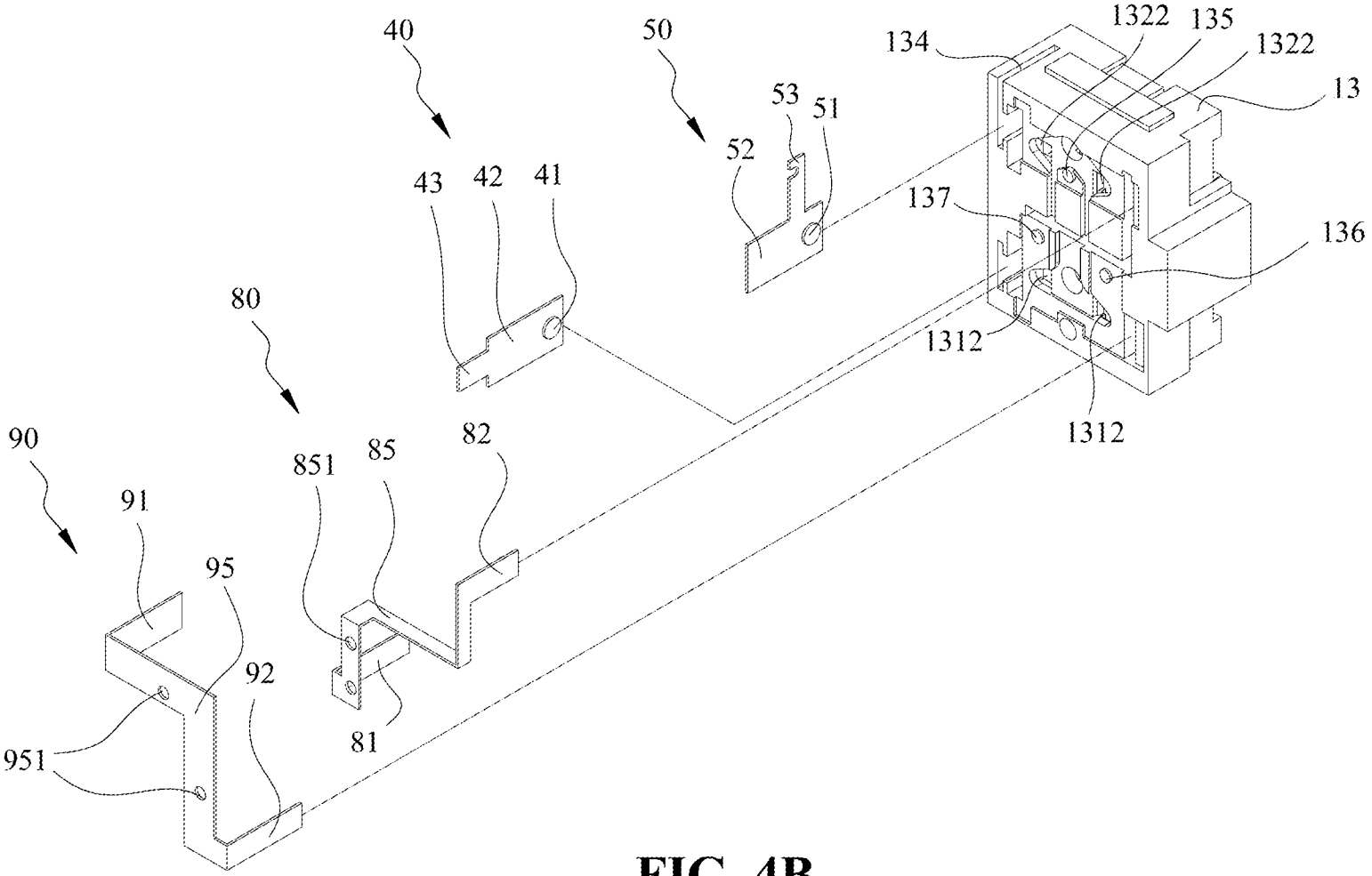
FIG. 4B is an exploded view, illustrating first and second electric connection plates together with the mounting seat of the safety socket according to the first embodiment of the present invention.
Figure 5A:
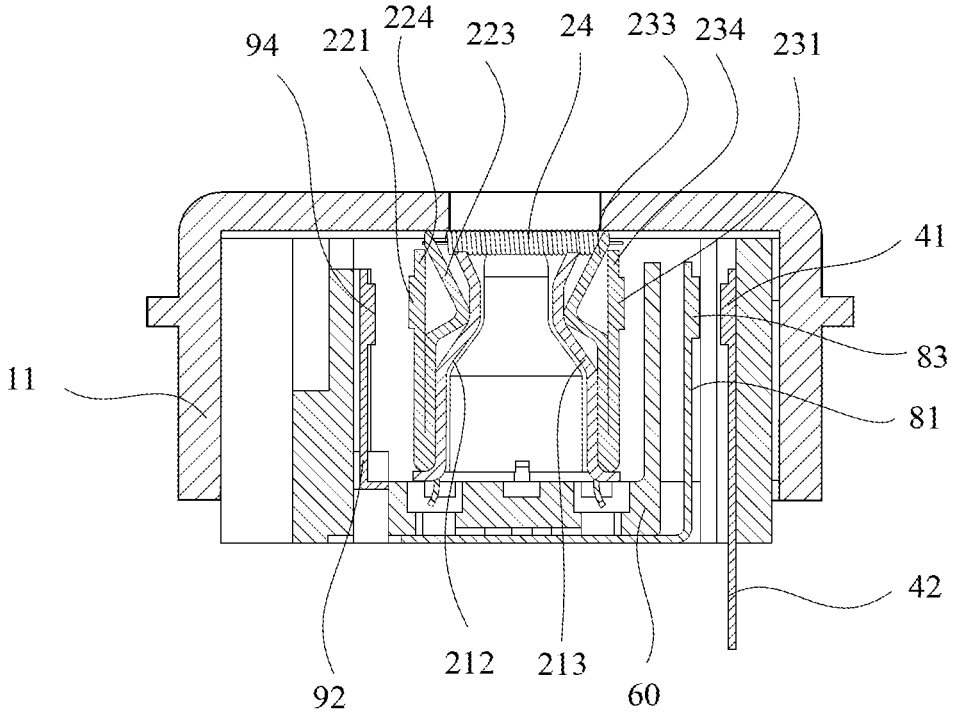
FIG. 5A shows a cross sectional view, illustrating interior of the mounting seat of the safety socket according to the first embodiment of the present invention.
Figure 5B:
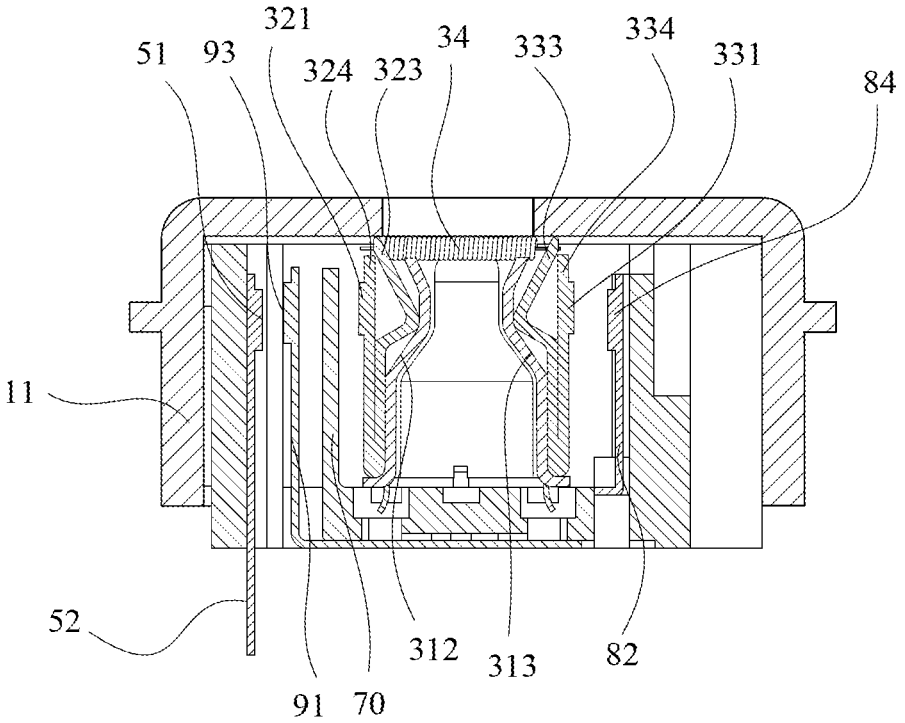
FIG. 5B shows a cross sectional view, illustrating interior of the mounting seat of the safety socket according to the first embodiment of the present invention from another angle.

Referring to FIGS. 1-5B, wherein, FIG. 1 is a perspective view showing a safety socket according to a first embodiment of the present invention; FIG. 2 is a perspective and exploded view showing the safety socket according to the first embodiment of the present invention; FIG. 3A is a top planer view showing a mounting seat of the safety socket according to the first embodiment of the present invention; FIG. 3B is a perspective view showing first and second conductive seats together with the mounting seat of the safety socket according to the first embodiment of the present invention; FIG. 3C is an exploded view of the first and second conductive seats in the safety socket according to the first embodiment of the present invention; FIG. 4A is a bottom view, illustrating interior of the mounting seat of the safety socket according to the first embodiment of the present invention; FIG. 4B is an exploded view, illustrating first and second electric connection plates together with the mounting seat of the safety socket according to the first embodiment of the present invention; FIG. 5A shows a cross sectional view, illustrating interior of the mounting seat of the safety socket according to the first embodiment of the present invention; and FIG. 5B shows a cross sectional view, illustrating interior of the mounting seat of the safety socket according to the first embodiment of the present invention from another angle. The safety socket of the present invention to permit insertion of a plug 2 therein, includes: a main body 10, a first conductive seat 20, a second conductive seat 30, a first electric connection plate 40, a second electric connection plate 50, a first insulated member 60, a second insulated member 70, a first conductive plate 80 and a second conductive plate 90.

The main body 10 includes a cover body 11, a bottom seat 12 and a mounting seat 13. The cover body 11 is formed with first and second plug holes 111, 112 and is mounted detachably on the bottom seat 12 to define a reception space therebetween to receive the mounting seat 13 consisting of a first chamber 131 and a second chamber 132, a first position block 1311 projecting from a junction adjoining a bottom part of the first chamber 131 and an inner side wall of a side of the first chamber 131 adjacent to the second chamber 132, a second position block (not numbered) projecting from a junction adjoining a bottom part of the second chamber 132 and an inner side wall of a side of the second chamber 132 adjacent to the first chamber 131 as shown in FIGS. 1, 2, 3A and 3B. To be more specific, the first chamber 131 has a bottom surface formed with a pair of first recesses 1312 and a pair of first channels 1313 extending in a width direction of the first chamber 131 through the pair of first recesses 1312. Each of the first recesses 1312 has a width in the length direction of the first chamber 131 greater than a width of each of the first channels 1313 in the length direction of the first chamber 131, as best shown in FIGS. 3A and 4A. The second chamber 132 has a bottom surface formed with a pair of second recesses 1322 and a pair of second channels (not numbered) extending in the width direction of the second chamber 132 through the pair of second recesses 1322. Each of the second recesses 1322 has a width in the length direction of the second chamber 132 greater than a width of each of the second channels in the length direction of the second chamber 132. Preferably, the pairs of first and second recesses 1312, 1322 extend through a bottom part of the mounting seat 13 in a through hole manner, as best shown in FIGS. 3A and 4B. an inner side wall of a side of the first chamber 131 distal from the second chamber 132 is formed with a pair of first guide channels 1314 while an inner side wall of a side of the second chamber 132 distal from the first chamber 132 is formed with a pair of second guide channels 1324, as best shown in FIGS. 2, 3A and 3B. The bottom seat 12 has a bottom part formed with a first insert hole 121, a lateral side formed with a vertical first insert slot 122 extending through its upper end thereof, as best shown in FIGS. 1, 2, 4A and 4B. The mounting seat 13 has a bottom part formed with a second insert hole 133, a lateral side formed with a vertical second insert slot 134 extending through its lower end thereof, as best shown in FIGS. 1, 2, 4A and 4B. The mounting seat 13 has a bottom part formed with three fixing posts 135, 136, 137, as best shown in FIGS. 4A and 4B.

The first conductive seat 20 is disposed in the first chamber 131 of the mounting seat 13 so as to be located below the first plug hole 111 in the cover body 11, includes: a first clamp couch 21 and two first pivot elements 22, 23, as shown in FIGS. 3A, 3B and 3C. The first clamp couch 21 includes a bottom part 211 having first and second sides in the width direction and first and second ends in the length direction and two first clamp arms 212, 213 integrally formed with an upper end of the bottom part 211 adjacent to the first and second ends of said bottom part 211 respectively. The first side of the bottom part 211 is formed with a first recess 2121 to permit extension of the first position block 1311 while the two first pivot elements 22, 23 are mounted pivotally on the bottom part 211 of the first clamp couch 21 adjacent to the first and second ends of said bottom part 211 and having two exterior side faces away from the first clamp couch 21 and each is formed with a contact point 221, 231. Preferably, a first protrusion 2131 projects outwardly from an outer side of each of the two first clamp arms 212, and extends slidably into a respective one of the first guide channels 1314. Preferably, the bottom part 211 of the first clamp couch 21 is formed with a pair of first through holes 2111 such that the first clamp arms 212, 213 are located between the pair of first through holes 2111. Each of the two first pivot elements 22, 23 has a bottom end which is punched in such a manner to form a first hook 222, 232 which extends into a respective of the first through holes 2111 and engaging the bottom part of the first clamp couch 21, thereby mounting the first pivot elements 22, 23 pivotally and detachably to the bottom part 211 adjacent to the first and second ends of the bottom part 211 respectively. The first conductive seat 20 further includes a first spring 24 having two opposite ends connected respectively to the first pivot elements 22, 23. Preferably, each of the first pivot elements 22, 23 is an integral piece defining a first inner wall 223, 233, a first outer wall 224, 234 and a first bent portion 225, 235 interconnecting bottoms of the first inner and outer walls 223, 233, 224, 234, wherein the first inner wall 223, 233 is bent in a Z-shaped and is oriented toward the other one of the first pivot elements 22, 23 and has a first hanging ear 2231, 2331 extending from an upper end thereof such that the two opposite ends of the first spring 24 engaging the first hanging ears 2231, 2331 such that the contact points 221, 231 of the first pivot elements 22, 23 are formed on one side surface of the first outer wall 224, 234 distal from the first inner wall 223, 233. Preferably, the first clamp couch 21 further includes a third clamp arm 214 integrally formed with the upper end of the bottom part 211 at one side thereof distal from the two first clamp arms 212, 213 such that the first recesses 2121 extends into a bottom end of the third clamp arm 214, the purpose of which is to provide additional clamping function relative to the first clamp arms 212, 213. It is to note that the first protrusions 2131 project outwardly from outer sides of the first clamp arms 212, 213 away from the third clamp arm 214.

The second conductive seat 30 is disposed in the second chamber 132 of the mounting seat 13 so as to be located below the second plug hole 112 in the cover body 11, includes: a second clamp couch 31 and two second pivot elements 32, 33, as shown in FIGS. 3A-3C. The second clamp couch 31 includes a bottom part 311 having first and second sides in the width direction and first and second ends in the length direction and two second clamp arms 312, 313 integrally formed with an upper end of the bottom part 311 adjacent to the first and second ends of the bottom part 311 respectively. The first side of the bottom part 311 is formed with a second recess 3121 to permit extension of the second position block 3311 while the two second pivot elements 32, 33 are mounted pivotally on the bottom part 311 of the second clamp couch 31 adjacent to the first and second ends of the bottom part 311 and having two exterior side faces away from the second clamp couch 31 and each is formed with a contact point 321, 331. Preferably, a second protrusion 3131 projects outwardly from an outer side of each of the two second clamp arms 312, 313 and extends slidably into a respective one of the second guide channels 1324. Preferably, the bottom part 311 of the second clamp couch 31 is formed with a pair of second through holes 3111 while the second clamp arms 312, 313 are located between the pair of second through holes 3111. Each of the two second pivot elements 32, 33 has a bottom end which is punched in such a manner to form a second hook 322, 332 extending into a respective of the second through holes 3111 and engaging the bottom part 311 of the second clamp couch 31, thereby mounting the second pivot elements 32, 33 23 pivotally and detachably to the bottom part 311 adjacent to the first and second ends of the bottom part 311 respectively. The second conductive seat 30 further includes a second spring 34 having two opposite ends connected respectively to the second pivot elements 32, 33. Preferably, each of the second pivot elements 32, 33 is an integral piece defining a second inner wall 323, 333, a second outer wall 324, 334 and a second bent portion 325, 335 interconnecting bottoms of the second inner and outer walls 323, 333, 324, 334, wherein the second inner wall 323,333 is bent in a Z-shaped and is oriented toward one of the second pivot elements 32, 33 and has a second hanging ear 3231, 3331 extending from an upper end thereof such that the two opposite ends of the second spring 34 engaging the second hanging ears 3231, 3331 such that the contact points 321, 331 of the second pivot elements 32, 33 are formed on one side of the second outer wall 324, 334 distal from the second inner wall 323, 333. Preferably, the second clamp couch 31 further includes a fourth clamp arm 314 integrally formed with the upper end of the bottom part 311 at one side thereof distal from the two second clamp arms 312, 313 such that the second recesses 3121 extends into a bottom end of the fourth clamp arm 314, the purpose of which is to provide additional clamping function relative to the second clamp arms 312, 313. It is to note that the second protrusions 3131 project outwardly from outer sides of the two second clamp arms 312, 313 away from the fourth clamp arm 314.

The first electric connection plate 40 is disposed on the mounting seat 13 for coupling with a first wire (not visible) and has a contact point 41. As shown in FIGS. 4A, 4B and 5A, the first electric connection plate 40 has a first end 42 formed with the contact point 41 and is located within the first chamber 131 and a second end 43 extending through the second insert hole 133 in the mounting seat 13, the first insert hole 121 in the bottom seat 12 for electrically connecting with the first wire.

The second electric connection plate 50 is disposed in the mounting seat 13 for coupling with a second wire (not visible) and has a contact point 51. As shown in FIGS. 1, 4A and 4B, the second electric connection plate 50 has a first end 52 formed with the contact point 51 and is located within the second chamber 132 and a second end 53 extending through the vertical second insert slot 134 in the mounting seat 13, the vertical first insert slot 122 in the bottom seat 12 for electrically connecting with the second wire.

The first insulated member 60 is disposed between the first electric connection plate 40 and one of the first pivot elements 23. As shown in FIGS. 3A and 5B, the first insulated member 60 extends upward from a bottom side of the first chamber 131 so as to be located between the first end 42 of the first electric connection plate 40 and one of the first pivot elements 23.

The second insulated member 70 is disposed between the second electric connection plate 50 and one of the second pivot elements 32. As shown in FIGS. 3A and 5B, the second insulated member 70 extends upward from a bottom side of the second chamber 132 so as to be located between the first end 52 of the second electric connection plate 50 and the one of the second pivot elements 32.

The first conductive plate 80 has a first end 81 extending into the first chamber 131 so as to be located between the first electric connection plate 40 and the first insulated member 60, spacing apart from the first electric connection plate 40 by a distance and a contact point 83 oriented toward the first electric connection plate 40 and a second end 82 that extends into the second chamber 132 so as to be located at one side of and spacing apart from the other one of the second pivot element 33 by a distance, and that has a contact point 84 oriented toward the other one of the second pivot element 33, as best shown in FIGS. 3A, 4A, 5A and 5B. To be more specific, the first conductive plate 80 further has a connection portion 85 interconnecting the first and second ends 81, 82 and formed with a positioning hole 851 permitting extension of one of the fixing posts 137, thereby mounting the first conductive plate 80 on the mounting seat 13.

The second conductive plate 90 has first and second ends 91, 92 spaced apart from the first conductive plate 80 such that the first end 91 of the second conductive plate 90 extends into the second chamber 132 so as to be located between the second electric connection plate 50 and the second insulated member 70, spacing from the second electric connection plate 50 by a distance and having a contact point 93 oriented toward the second electric connection plate 50. The second end 92 of the second conductive plate 90 extends into the first chamber 131 so as to be located at one side and spacing apart from the remaining one of the first pivot elements 22 by a distance, having a contact point 94 oriented toward the remaining one of the first pivot elements 22, as best shown in FIGS. 3A, 4A, 5A and 5B. To be more specific, the second conductive plate 90 further has a connection portion 95 interconnecting the first and second ends 91, 92 and formed with two positioning holes 951 permitting extension of another two of the fixing posts 135, 136, thereby mounting the second conductive plate 90 on the mounting seat 13 in such a manner that the connection portion 85 of the first conductive plate 80 encircles around and is spaced apart from the connection portion 95 of the second conductive plate 90.

After assembly of the safety socket of the present invention and prior to insertion of two terminals 201, 201' of the plug 2 respectively into the first and second plug holes 111, 112 in the cover body 11, the first and second electric connection plates 40, 50, the first and second insulated members 60, 70, the two first pivot elements 22, 23, the two second pivot elements 32, 33 and the first and second ends 81, 82, 91, 92 of the first and second conductive plates 80, 90 are spaced apart from one another, thereby electrically disconnected relative to one another, as best shown in FIGS. 5A and 5B. In other words, an external electrical power cannot pass through the safety socket of the present invention.

Figure 6A:
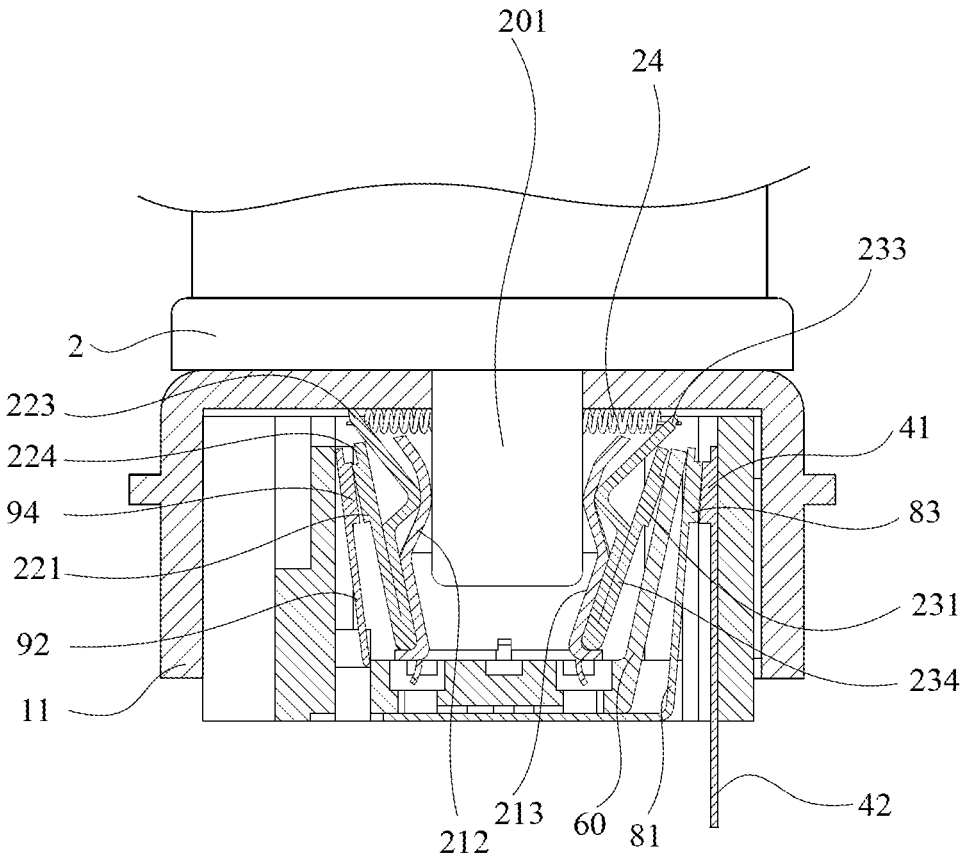
FIG. 6A shows a cross sectional view, illustrating interior of the first conductive seat of the safety socket according to the first embodiment of the present invention when terminals of a plug is inserted therein.
Figure 6B:
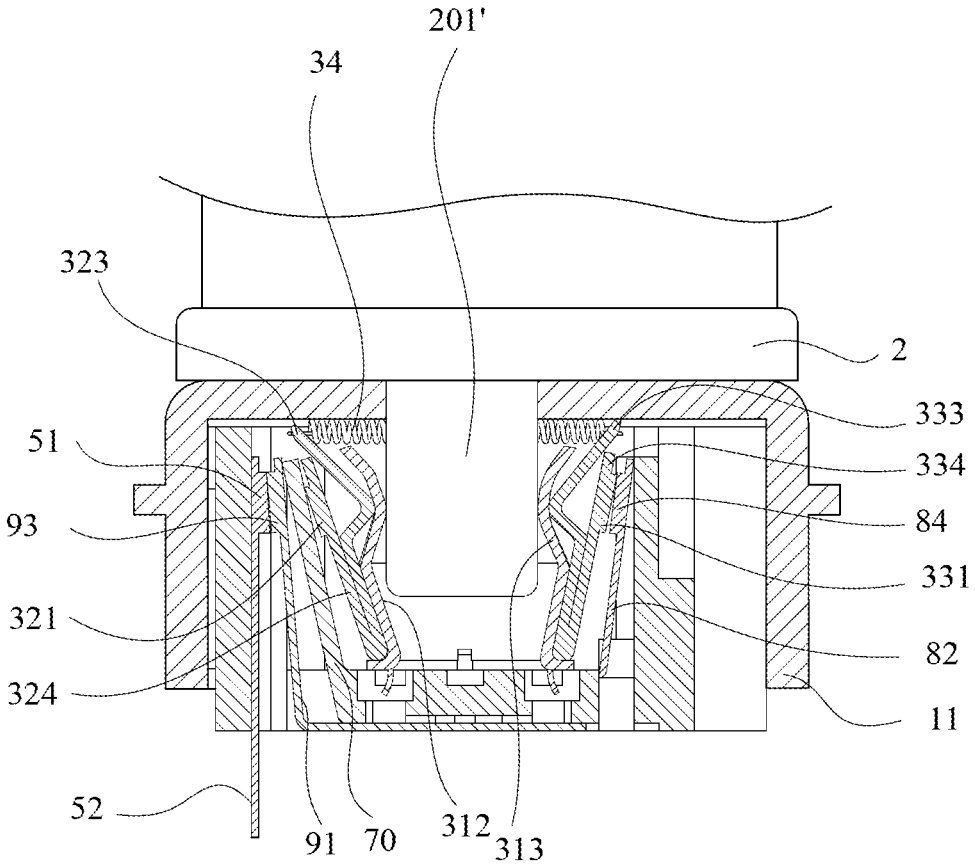
FIG. 6B shows a cross sectional view, illustrating interior of the second conductive seat of the safety socket according to the first embodiment of the present invention when terminals of a plug is inserted therein.

Referring to FIGS. 6A and 6B, wherein FIG. 6A shows a cross sectional view illustrating interior of the first conductive seat of the safety socket according to the first embodiment of the present invention when terminals of a plug are inserted therein; and FIG. 6B shows a cross sectional view, illustrating interior of the second conductive seat of the safety socket according to the first embodiment of the present invention when terminals of a plug are inserted therein. As shown, insertion of two terminals 201, 201' of the plug 2 respectively into the first and second plug holes 111, 112 in the cover body 11 results in spreading the two first clamp arms 212, 213 away from each other in order to clamp one of the two terminals 201 among the third clamp arm 214 and two first clamp arms 212, 213, as best shown in FIG. 6A, which in turn, causes pivoting the two first pivot elements 22, 23 away from each other about the first hooks 222, 231 relative to the bottom part 211, thereby stretching the opposite ends of the first spring 24 away from each other, where the contact point 231 of one of the first pivot elements 23 pushes the first insulated member 60, which simultaneously pushes the first end 42 of the first electric connection plate 40 such that the contact point 41 of the first electric connection plate 40 touches the contact point 83 at the first end 81 of the first conductive plate 80 while the contact point 221 of the remaining one of the first pivot elements 22 touches with the contact point 94 at the second end 92 of the second conductive plate 90, as best shown in FIG. 6A; and simultaneously causing spreading the two second clamp arms 312, 313 away from each other in order to clamp the remaining one of the two terminals 201' among the two second clamp arms 312, 313, and the fourth clamp arm 314, which in turn, pivoting the two second pivot elements 32, 33 away from each other about the second hooks 322, 332 relative to the bottom part 311, thereby stretching the opposite ends of the second spring 34 away from each other, where the contact point 321 of one of the second pivot elements 32 pushes the second insulated member 70, which simultaneously pushes the first end 52 of the second electric connection plate 50 such that the contact point 51 at the first end 52 of the second electric connection plate 50 touches with the contact point 93 at the first end 91 of the second conductive plate 90 while the contact point 331 of the remaining second pivot elements 33 touches with the contact point 84 at the second end 82 of the second conductive plate 80, as best shown in FIG. 6B; thereby establishing electrical connection among the first and second electric connection plates 40,50, the first and second electric conductive plates 80, 90, the remaining one of the first pivot elements 22, the remaining one of the second pivot elements 33 and the two terminals 201, 201' of the plug 2.

In the same manner, removal of the two terminals 201, 201' of the plug 2 respectively from the first and second plug holes 111, 112 in the cover body 11 results in placing the two first and second pivot elements 22, 23, 32, 33 to their initial positions, as best shown in FIGS. 5A and 5B, thereby spacing the first and second electric connection plates 40, 50, the first and second insulated members 60, 70, the two first and second pivot elements 22, 23, 32, 33 and the first and second ends 81, 91 of the first and second conductive plates 80, 90, thereby cutting off electrical connection between the two first pivot elements 22, 23 and the two second pivot elements 32, 33. When the safety socket of the present invention is not in use, the two first and second pivot elements 22, 23, 32, 33 do not contact with other components.

As described above, the safety socket according to the first embodiment of the present invention has the advantages, like lesser components, easy to assemble and is low in manufacturing costs.

When in the non-used condition, like children holding a conductive foreign object, such as a metal rod, a wire or their fingers, insert into the plug holes 111, 112 in the cover body 11 of the main body 10, the configuration of the inserted objects even though can past through the plug holes 111, 112, but cannot expand the first and second pivot elements 22, 23, 32, 33 of the first and second conductive seats 20, 30 away from each other due to tension force of the springs, thereby spacing the first and second electric connection plates 40, 50, the first and second insulated members 60, 70, the two first and second pivot elements 22, 23, 32, 33 and the first and second ends 81, 91 of the first and second conductive plates 80, 90 and hence cutting off electrical connection between the two first pivot elements 22, 23 and the two second pivot elements 32, 33. Hence, no electrocution will occur due to insertion of the conductive foreign objects.

One distinct feature of the present invention resides in that the second inner walls 223, 233, 323, 333 of the first and second pivot elements 22, 23, 32, 33 are bent in a Z-shaped to facilitate pivoting of the pivot elements 22, 23, 32, 33 away from each other and enhancing the clamping action of the inserted terminals 201, 201' of the plug 2.

Preferably, the contact points 221, 231, 321, 331, 41, 51, 83, 84, 93, 94 are silver coated for providing better electrical connection.

Preferably, the bottom part of the bottom seat 12 is formed with a plurality of dissipation holes to facilitate expelling of heat, wetness of moisture from within the safety socket of the present invention.

Figure 7:
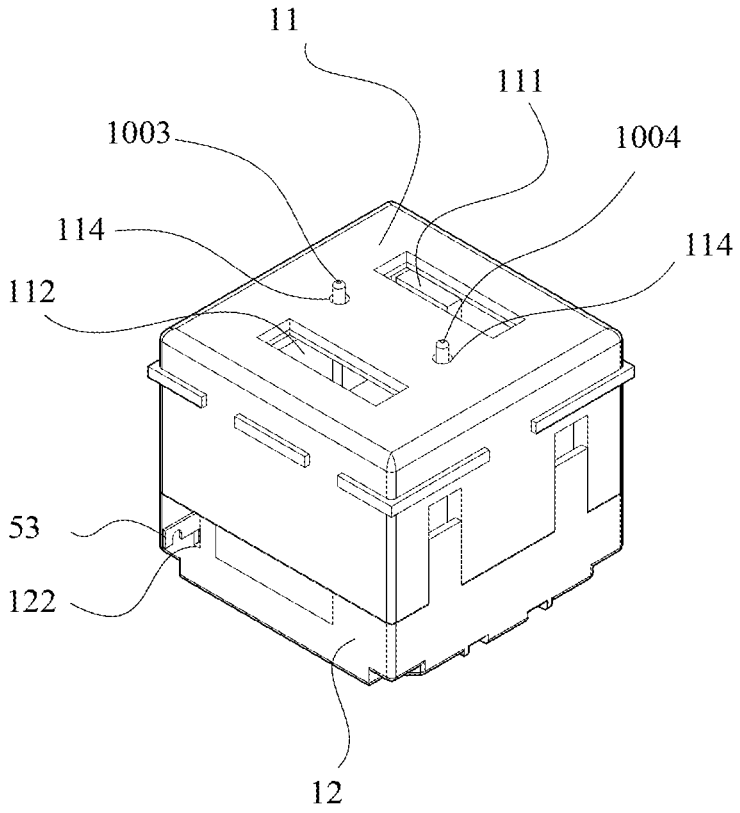
FIG. 7 is a perspective view showing a safety socket according to a second embodiment of the present invention.
Figure 8:
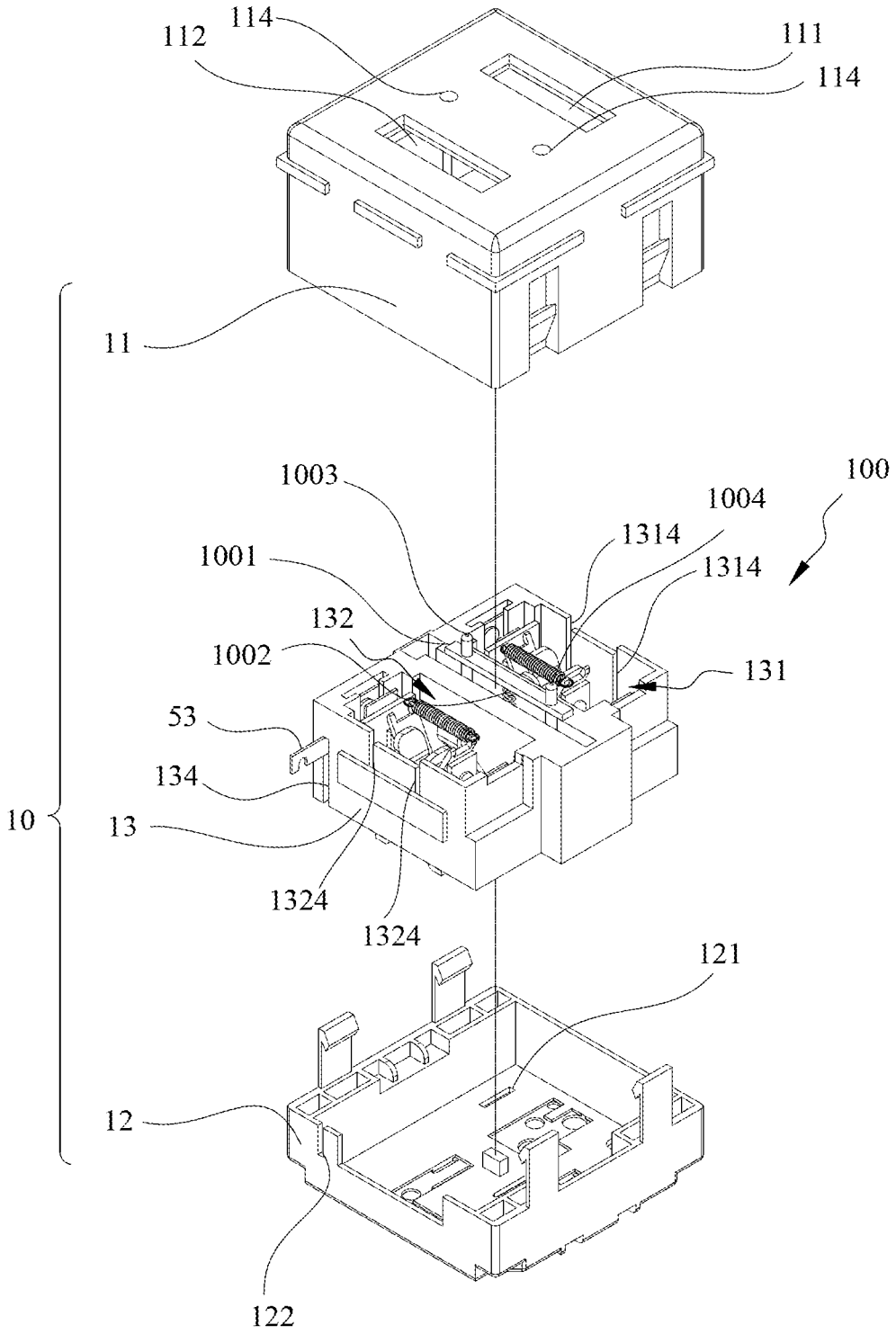
FIG. 8 is an exploded and perspective view showing the safety socket according to the second embodiment of the present invention.
Figure 9A:
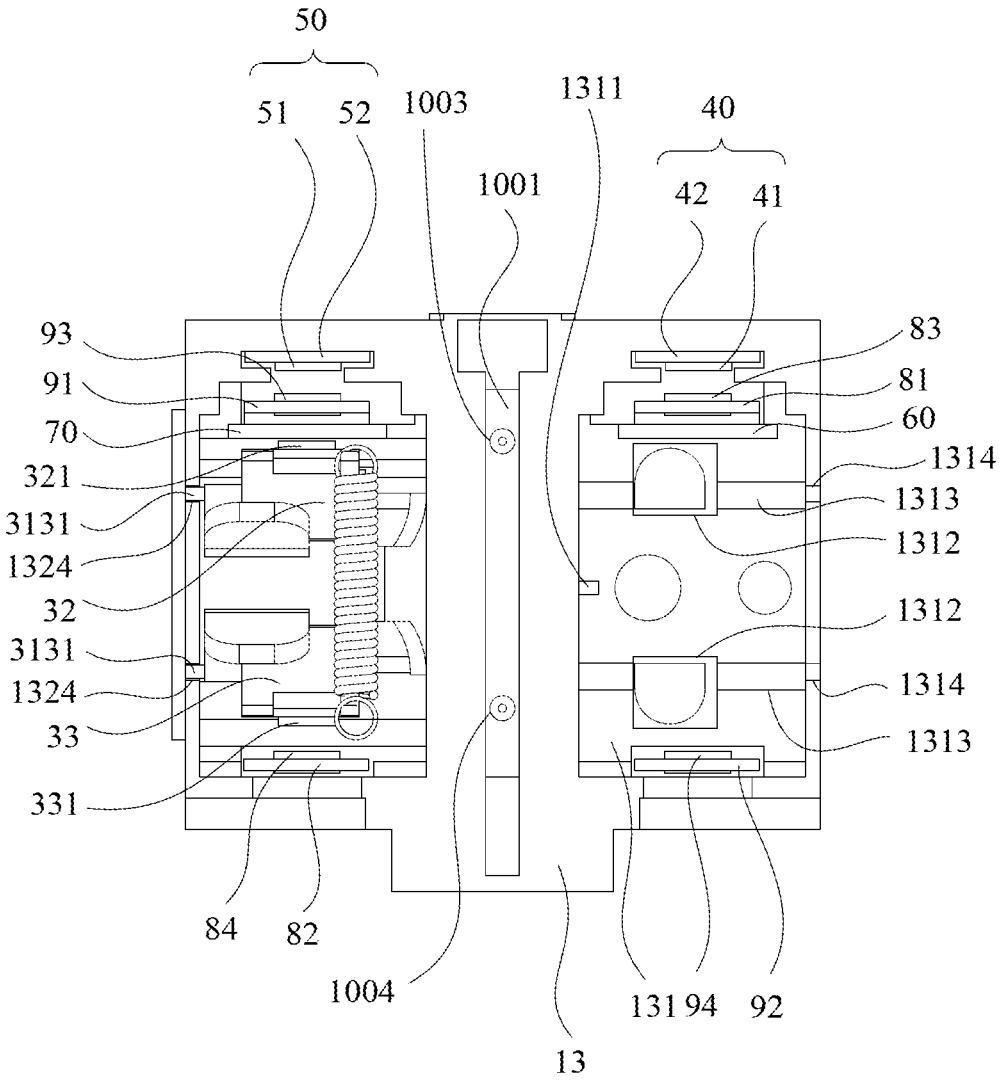
FIG. 9A is a top planer view showing interior of a mounting seat of the safety socket according to the second embodiment of the present invention.
Figure 9B:
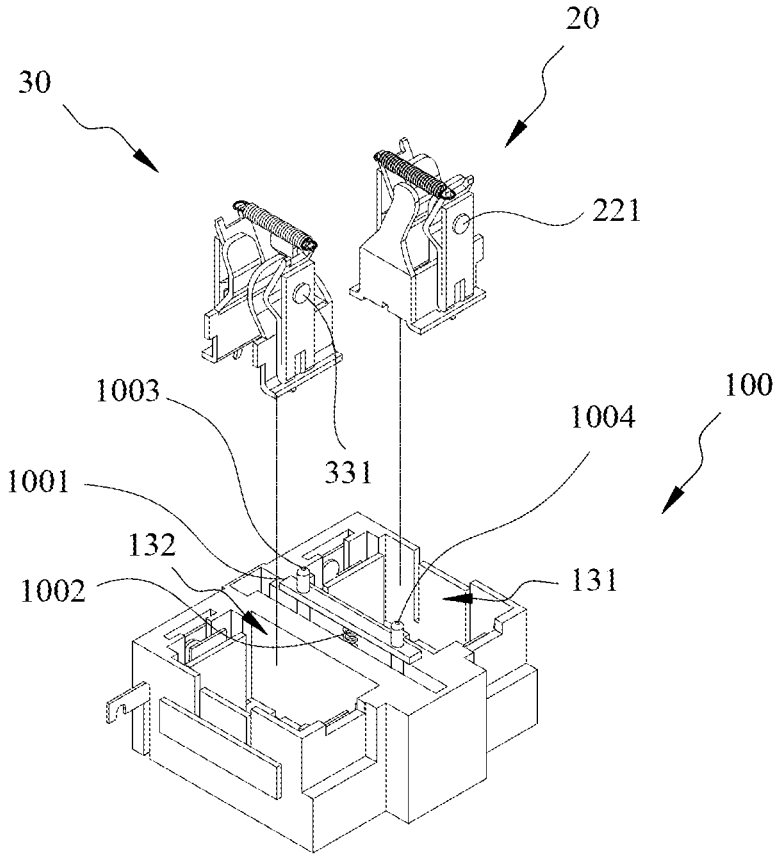
FIG. 9B is a perspective view showing first and second conductive seats together with the mounting seat of the safety socket according to the second embodiment of the present invention.
Figure 9C:
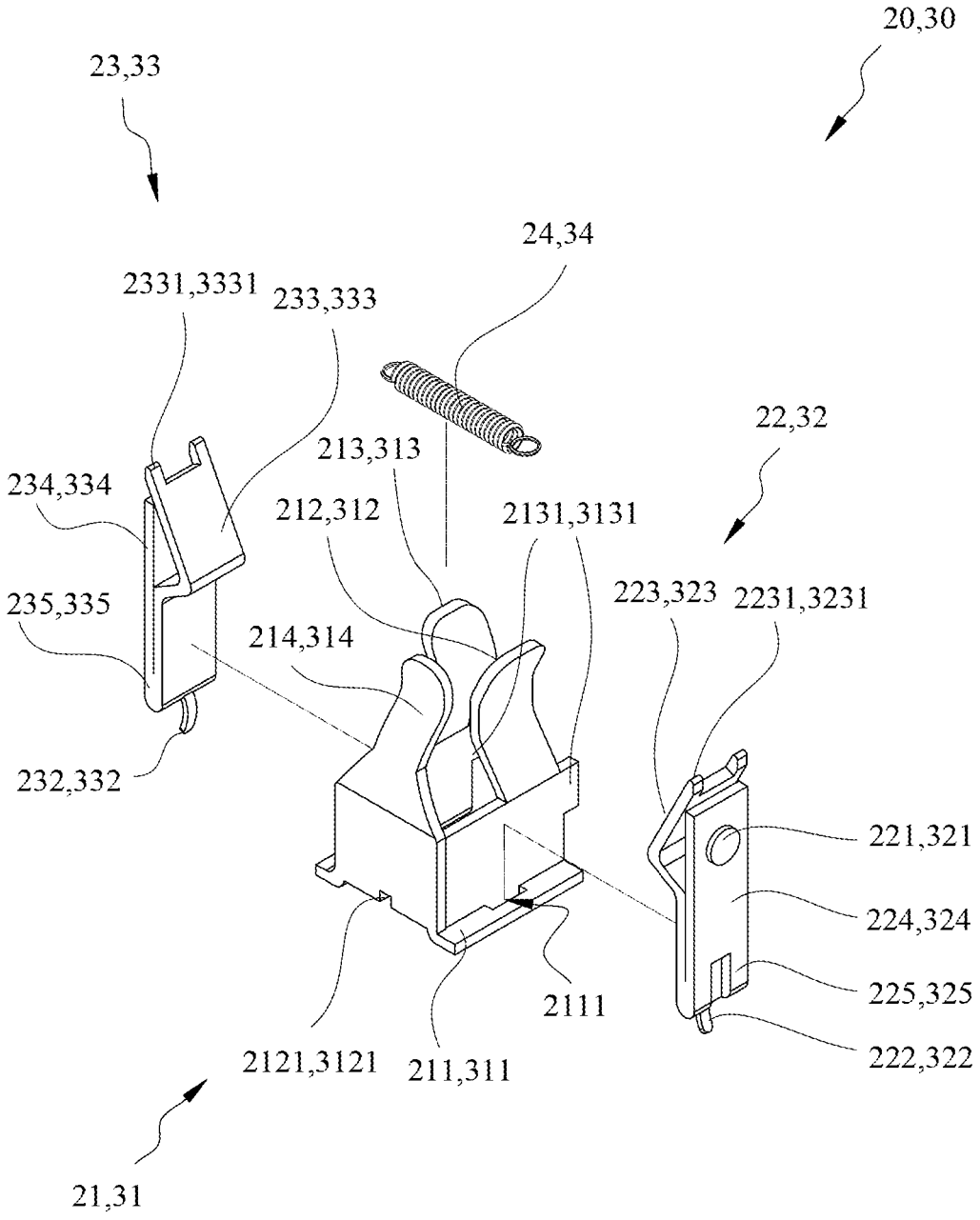
FIG. 9C is an exploded view of the first and second conductive seats in the safety socket according to the second embodiment of the present invention.
Figure 10A:
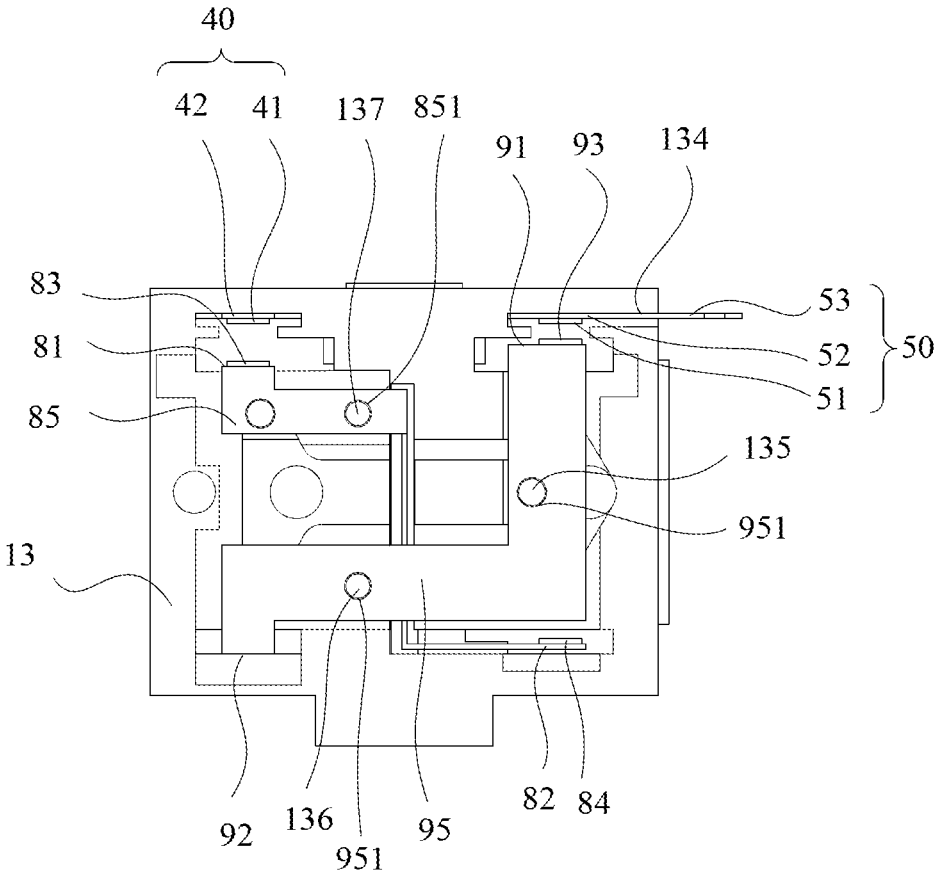
FIG. 10A is a bottom view, illustrating interior of the mounting seat of the safety socket according to the second embodiment of the present invention.
Figure 10B:
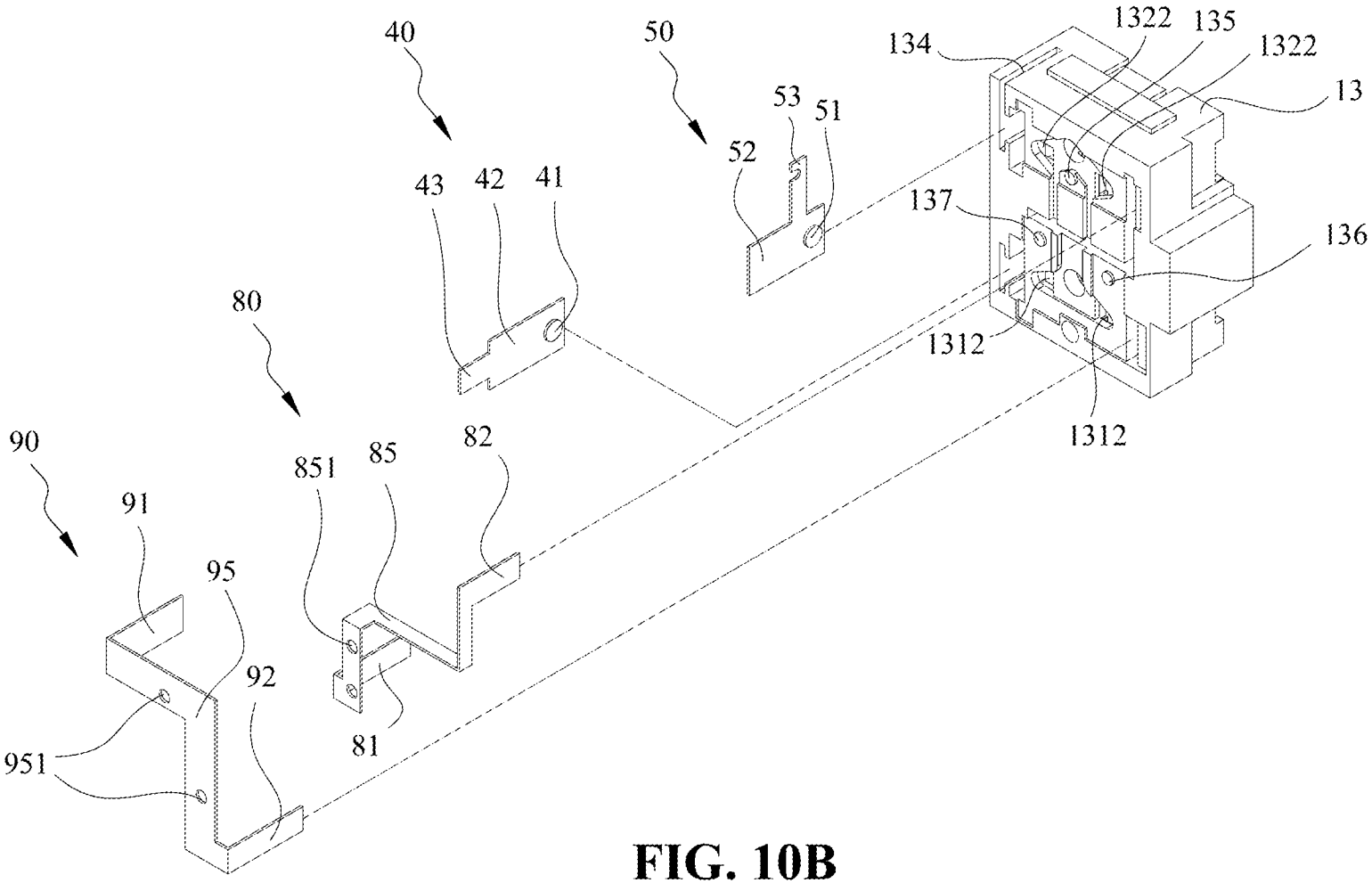
FIG. 10B is an exploded view, illustrating first and second electric connective plates together with the mounting seat of the safety socket according to the second embodiment of the present invention.
Figure 11A:
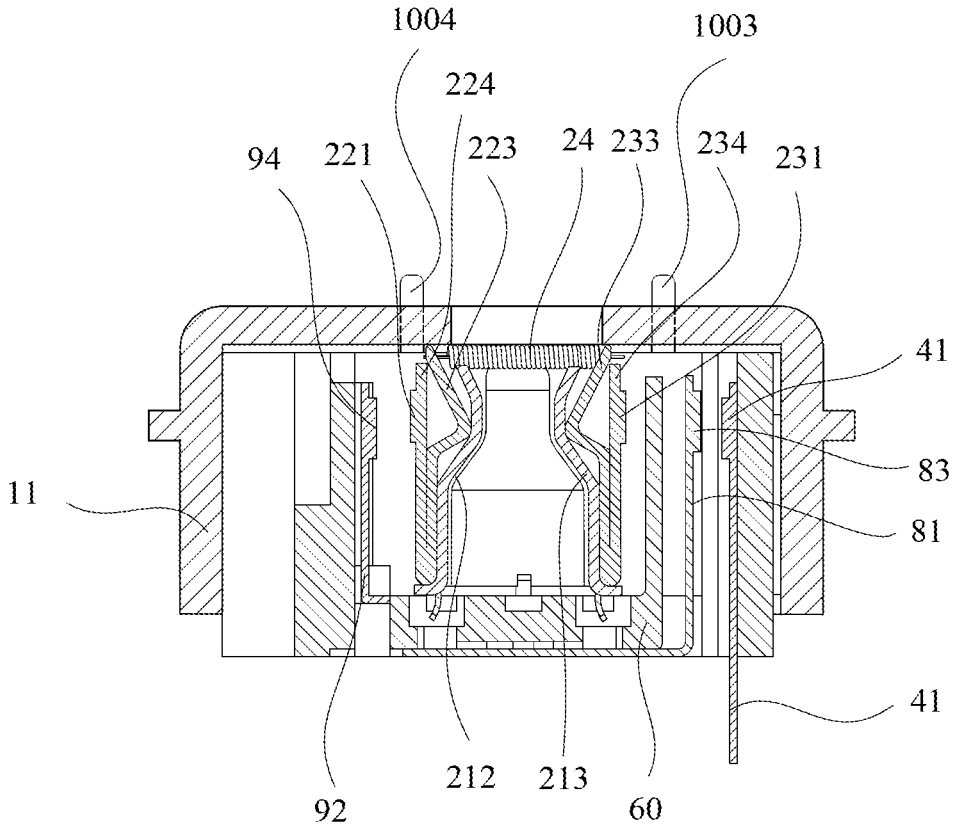
FIG. 11A shows a cross sectional view of the safety socket according the second embodiment of the present invention.
Figure 11B:
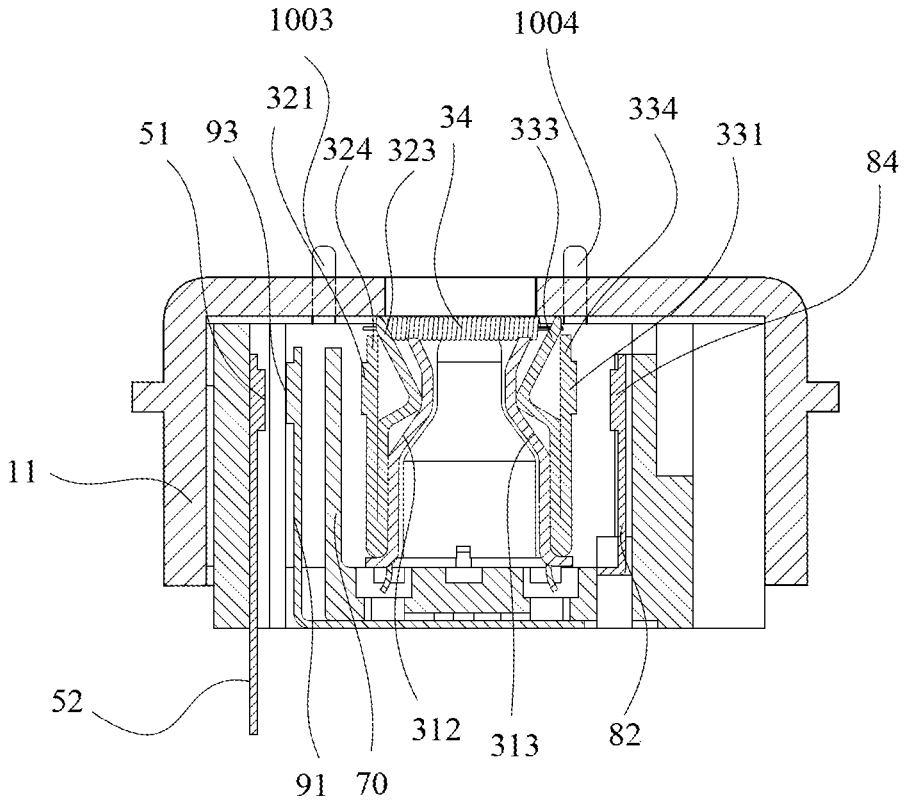
FIG. 11B shows a cross sectional view of the safety socket according the second embodiment of the present invention from another angle.

Referring to FIGS. 7-11B, wherein, FIG. 7 is a perspective view showing a safety socket according to a second embodiment of the present invention; FIG. 8 is an exploded and perspective view showing the safety socket according to the second embodiment of the present invention; FIG. 9A is a top planer view showing interior of a mounting seat of the safety socket according to the second embodiment of the present invention; FIG. 9B is a perspective view showing first and second conductive seats together with the mounting seat of the safety socket according to the second embodiment of the present invention; FIG. 9C is an exploded view of the first and second conductive seats in the safety socket according to the second embodiment of the present invention; FIG. 10A is a bottom view, illustrating interior of the mounting seat of the safety socket according to the second embodiment of the present invention; FIG. 10B is an exploded view, illustrating first and second electric connective plates together with the mounting seat of the safety socket according to the second embodiment of the present invention; FIG. 11A shows a cross sectional view of the second embodiment of the present invention; and FIG. 11B shows a cross sectional view of the second embodiment of the present invention from another angle. The second embodiment is similar to the first embodiment in structure, except that the first and second plug holes 111, 112 in the first embodiment are grounded via a ground connection hole 113 while the second embodiment is not provided with the ground connection hole. The cover body 11 of the second embodiment is further formed with two through holes 114, and an On-and-Off switch device 100 is disposed on the mounting seat 13 and includes a plate member 1001, a third spring 1002 disposed between a bottom part of the plate member 1001 and a bottom part of the mounting seat 13, a first switch 1003 and a second switch 1004 mounted on a top part of the plate member 1001 in such a manner to extend through the two through holes 114 in the cover body 11.

Figure 12A:
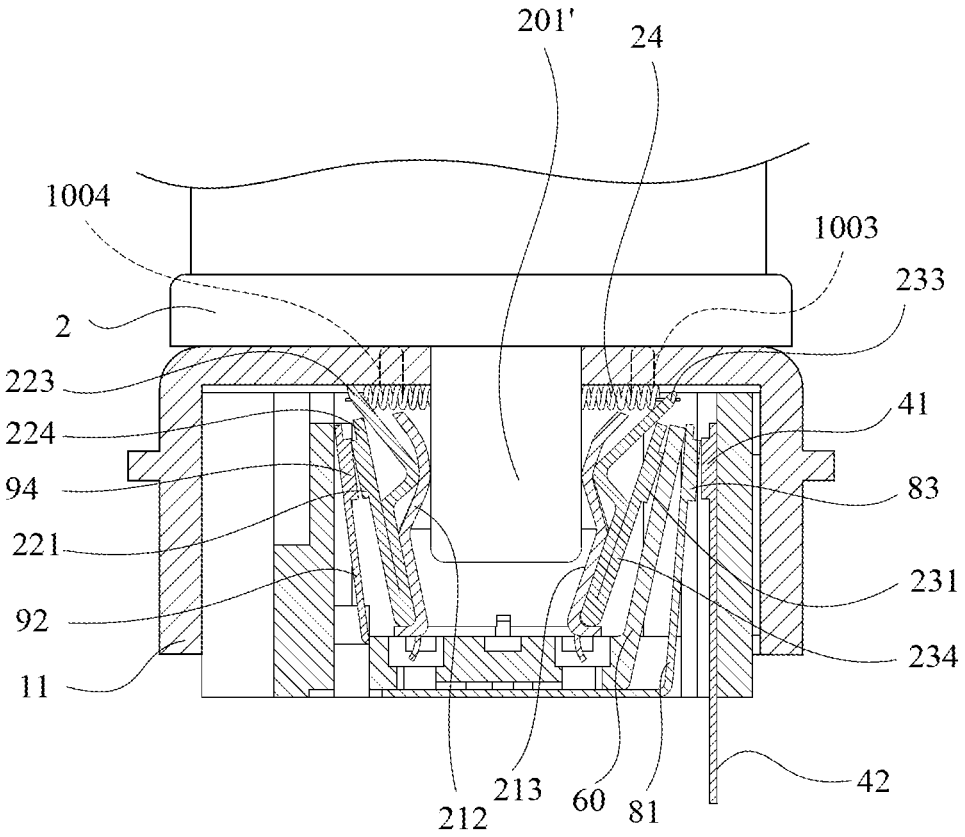
FIG. 12A shows a cross sectional view, illustrating interior of the first conductive seat of the safety socket according to the second embodiment of the present invention when terminals of a plug are inserted therein.
Figure 12B:
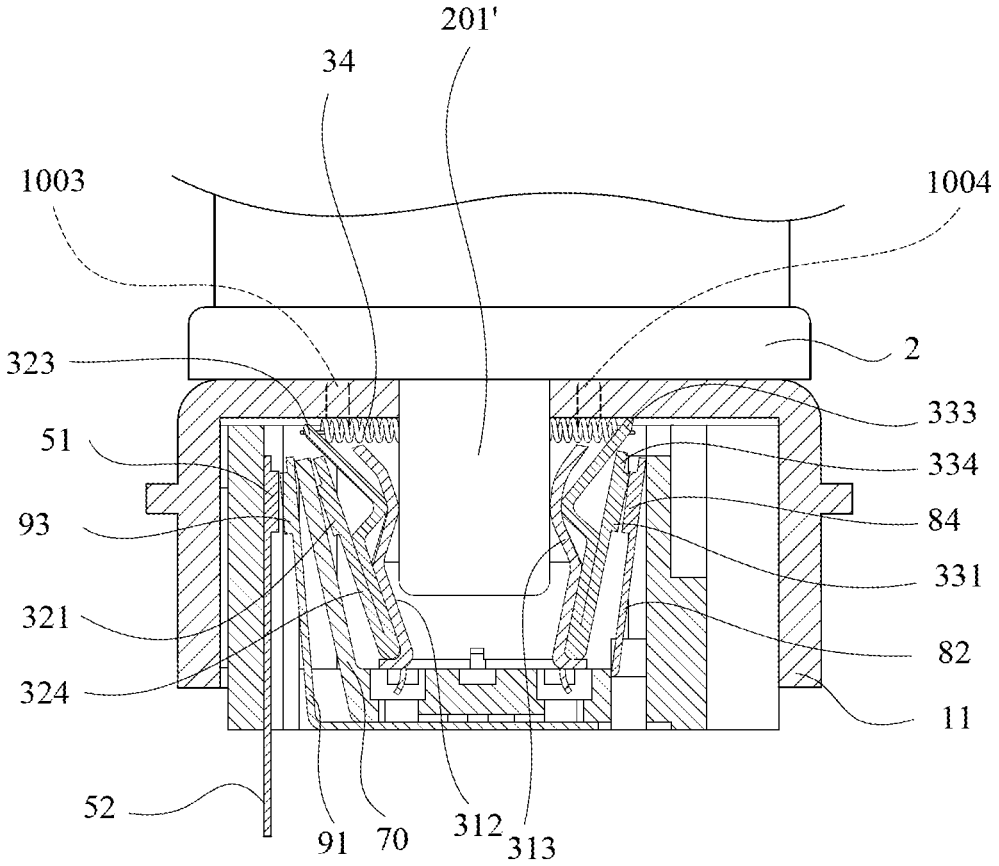
FIG. 12B shows a cross sectional view, illustrating interior of the second conductive seat of the safety socket according to the second embodiment of the present invention when terminals of a plug are inserted therein.

Referring to FIGS. 12A and 12B, wherein, FIG. 12A shows a cross sectional view illustrating interior of the first conductive seat of the safety socket according to the second embodiment of the present invention when terminals of a plug are inserted therein; and FIG. 12B shows a cross sectional view, illustrating interior of the second conductive seat of the safety socket according to the second embodiment of the present invention when terminals of a plug are inserted therein. As shown, insertion of two terminals 201, 201' of the plug 2 respectively into the first and second plug holes 111, 112 in the cover body 11 results in causing downward movement of the first and second switches 1003, 1004, which, in turn, causes movement of the plate member 1001 downward so as to compress the third spring 1002 such that the first and second switches 1003, 1004 respectively and electrically contact with the first and second conduction plates 40, 50, thereby establishing electrical connection among the first and second electric connection plates 40, 50, the first and second conductive plates 80, 90, one of the first pivot elements 22 and one of the second pivot elements 33, the first and second switches 1003, 1004 and the terminals 201, 201' of the plug 2; wherein, removal of the two terminals 201, 201' of the plug 2 respectively from the first and second plug holes 111, 112 in the cover body 11, as shown in FIGS. 11A and 11B, results in upward movement of the plate member 1001 due to restoration force of the third spring 1002, which, in turn, causes upward movement of the first and second switches 1003, 1004 and separating the first and second conductive plates 80, 90 such that the first and second electric connection plates 40, 50, the first and second insulated members 60, 70, the two first pivot elements 22, 23, the two second pivot elements 32, 33, the first and second ends 81, 91 of the first and second connective plates 80, 90 are disconnected electrically from the first and second switches 1003, 1004.

The second embodiment of the present invention has the advantages of the first embodiment, is further provided with an On-and-Off switch device 100 for serving a second safety measure to prevent from electric shock. During insertion of the terminals 201, 201' of the plug 2 into the first and second plug holes 111, 112 and/or removal of the terminals 201, 201' of the plug 2 from the first and second plug holes 111, 112 in the cover body 11, the first and second switches 1003, 1004 provide electrical disconnection between the first and second electric connection plates 40, 50, the first and second insulated members 60, 70, the two first and second pivot elements 22, 23, 32, 33 and the first and second ends 81, 91 of the first and second connective plates 80, 90. Hence, no electrical discharge phenomenon and/or arc light phenomenon will occur.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A safety socket to pet nit insertion of a plug therein, comprising:

a main body including a cover body, a bottom seat and a mounting seat, said cover body being formed with first and second plug holes and mounted detachably on said bottom seat to define a reception space therebetween to receive said mounting seat consisting of a first chamber and a second chamber, a first position block projecting from a junction adjoining a bottom part of said first chamber and an inner side wall of a side of said first chamber adjacent to said second chamber, a second position block projecting from a junction adjoining a bottom part of said second chamber and an inner side wall of a side of said second chamber adjacent to said first chamber;

a first conductive seat disposed in said first chamber of said mounting seat so as to be located below said first plug hole in said cover body, including: a first clamp couch and two first pivot elements, said first clamp couch including a bottom part having first and second sides in the width direction and first and second ends in the length direction and two first clamp arms integrally formed with an upper end of said bottom part adjacent to said first and second ends of said bottom part respectively, said first side of said bottom part being formed with a first recess to permit extension of said first position block while said two first pivot elements are mounted pivotally on said bottom part of said first clamp couch adjacent to said first and second ends of said bottom part and having two exterior side faces away from said first clamp couch and each is formed with a contact point;

a second conductive seat disposed in said second chamber of said mounting seat so as to be located below said second plug hole in said cover body, including: a second clamp couch and two second pivot elements, said second clamp couch including a bottom part having first and second sides in the width direction and first and second ends in the length direction and two second clamp arms integrally formed with an upper end of said bottom part adjacent to said first and second ends of said bottom part respectively, said first side of said bottom part being formed with a second recess to permit extension of said second position block while said two second pivot elements are mounted pivotally on said bottom part of said second clamp couch adjacent to said first and second ends of said bottom part and having two exterior side faces away from said second clamp couch and each is forming with a contact point;

a first electric connection plate disposed on said mounting seat for coupling with a first wire and having a contact point;

a second electric connection plate disposed in said mounting seat for coupling with a second wire and having a contact point;

a first insulated member disposed between said first electric connection plate and one of said first pivot elements;

a second insulated member disposed between said second electric connection plate and one of said second pivot elements;

a first conductive plate having a first end extending into said first chamber so as to be located between said first electric connection plate and said first insulated member, spacing apart from said first electric connection plate by a distance and having a contact point oriented toward said first electric connection plate and a second end extending into said second chamber so as to be located at one side of and spaced apart from the other one of said second pivot elements by a distance, and having a contact point oriented toward the other one of said second pivot elements; and a second conductive plate having first and second ends spaced apart from said first conductive plate, said first end of said second conductive plate extending into said second chamber so as to be located between said second electric connection plate and said second insulated member, spaced from said second electric connection plate by a distance and having a contact point oriented toward said second electric connection plate, said second end of said second conductive plate extending into said first chamber so as to be located at one side and spaced apart from the remaining one of said first pivot elements by a distance, having a contact point oriented toward the remaining one of said first pivot elements;

wherein, insertion of two terminals of the plug respectively into said first and second plug holes in said cover body results in spreading said two first clamp arms away from each other in order to clamp one of said two terminals therebetween, which in turn, causes pivoting said two first pivot elements away from each other relative to the bottom part, where said contact point of one of said first pivot elements pushes said first insulated member, which simultaneously pushes said first electric connection plate such that said contact point of said first electric connection plate touches said contact point at said first end of said first conductive plate while said contact point of the remaining one of said first pivot elements touches with said contact point at said second end of said second conductive plate, and simultaneously causing spreading said two second clamp arms away from each other in order to clamp the remaining one of said two terminals between the second clamp arms, which in turn, pivots said two second pivot elements away from each other relative to the bottom part, where said contact point of one of said second pivot elements pushes said second insulated member, which simultaneously pushes said second electric connection plate such that said contact point of said second electric connection plate touches with said contact point at said first end of said second conductive plate while said contact point of the remaining second pivot elements touches with said contact point at said second end of said first conductive plate, thereby establishing electrical connection among said first and second electric connection plates, said first and second electric conductive plates, the remaining one of said first pivot elements, the remaining one of said second pivot elements and said two terminals of the plug;

wherein, removal of said two terminals of the plug respectively from said first and second plug holes in said cover body results in placing said two first and second pivot elements to their initial positions, and pushing said two first clamp arms and said two second clamp arms to their initial positions, thereby spacing said first and second electric connection plates, said first and second insulated members, said two first and second pivot elements and said first and second ends of said first and second conductive plates, thereby cutting off electrical connection there among.

2. The safety socket according to claim 1, wherein said bottom part of said first clamp couch is forming with a pair of first through holes, said first clamp arms being located between said pair of first through holes, each of said two first pivot elements has a bottom end from which a first hook extends into a respective of said first through holes and engaging said bottom part of said first clamp couch, thereby mounting said first pivot elements pivotally and detachably to said bottom part adjacent to said first and second ends of said bottom part respectively, said first conductive seat further including a first spring having two opposite ends connected respectively to said first pivot elements; wherein, said bottom part of said second clamp couch is formed with a pair of second through holes, said second clamp arms being located between said pair of second through holes, each of said two second pivot elements has a bottom end from which a second hook extends into a respective of said second through holes and engaging said bottom part of said second clamp couch, thereby mounting said second pivot elements pivotally and detachably to said bottom part adjacent to said first and second ends of said bottom part respectively, said second conductive seat further including a second spring having two opposite ends connected respectively to said second pivot elements; wherein, spreading said two first pivot elements away from each other due to insertion of one of said of two terminals of the plug simultaneously results in pivoting of said two first pivot elements about said first hooks away from said bottom part, thereby causing stretching away of two ends of said first spring relative to each other, wherein, spreading said two second pivot elements away from each other due to insertion of the other one of said of two terminals of the plug simultaneously results in pivoting of said two second pivot elements about said second hooks away from said bottom part, thereby causing stretching away of two ends of said second spring relative to each other, and wherein, removal of said two terminals of the plug respectively from said first and second plug holes in said cover body results in placing said two first and second pivot elements to their initial positions by virtue of restoration forces of said first and second springs.

3. The safety socket according to claim 2, wherein said first chamber has a bottom surface formed with a pair of first recesses permitting extension of said first hooks of said first pivot elements once said first pivot elements are mounted pivotally into said first through holes in said bottom part of said first clamp couch, said second chamber has a bottom surface formed with a pair of second recesses permitting extension of said second hooks of said second pivot elements once said second pivot elements are mounted pivotally into said second through holes in said bottom part of said second clamp couch.

4. The safety socket according to claim 3, wherein said pairs of first and second recesses extends through a bottom part of said mounting seat in a through hole manner.

5. The safety socket according to claim 3, wherein said bottom surface of said first chamber is further dented to form with a pair of first channels extending in said width direction of said first chamber through said pair of first recesses, each of said first recesses having a width in the length direction of said first chamber greater than a width of each of said first channels in the length direction of said first chamber; wherein said bottom surface of said second chamber is further dented to form with a pair of second channels extending in said width direction of said second chamber through said pair of second recesses, each of said second recesses having a width in said length direction of said second chamber greater than a width of each of said second channels in said length direction of said second chamber.

6. The safety socket according to claim 4, wherein said bottom surface of said first chamber is further dented to form with a pair of first channels extending in said width direction of said first chamber through said pair of first recesses, each of said first recesses having a width in the length direction of said first chamber greater than a width of each of said first channels in the length direction of said first chamber; wherein said bottom surface of said second chamber is further dented to form with a pair of second channels extending in said width direction of said second chamber through said pair of second recesses, each of said second recesses having a width in said length direction of said second chamber greater than a width of each of said second channels in said length direction of said second chamber.

7. The safety socket according to claim 2, wherein each of said first pivot elements is an integral piece defining a first inner wall, a first outer wall and a first bent portion interconnecting bottoms of said first inner and outer walls, wherein said first inner wall is bent in a Z-shape and is oriented toward the other one of said first pivot elements and has a first hanging ear extending from an upper end thereof, said two ends of said first spring engaging said first hanging ears of said first pivot elements such that contact points of said first pivot elements are formed on one side surface of said first outer wall distal from said first inner wall; wherein, each of said second pivot elements is an integral piece defining a second inner wall, a second outer wall and a second bent portion interconnecting bottoms of said second inner and outer walls, wherein said second inner wall is bent in a Z-shape and is oriented toward said one of said first pivot elements and has a second hanging ear extending from an upper end thereof, said two ends of said second spring engaging said second hanging ears such that contact points of said second pivot elements are formed on one side of said second outer wall distal from said second inner wall.

8. The safety socket according to claim 1, wherein an inner side wall of a side of said first chamber distal from said second chamber is folioed with a pair of first guide channels, an inner side wall of a side of said second chamber distal from said first chamber is formed with a pair of second guide channels, a first protrusion projecting outwardly from an outer side of each of said two first clamp arms and extending slidably into a respective one of said first guide channels, a second protrusion projecting outwardly from an outer side of each of said two second clamp arms and extending slidably into a respective one of said second guide channels.

9. The safety socket according to claim 1, wherein said bottom seat has a bottom part formed with a first insert hole, a lateral side formed with a vertical first insert slot extending through its upper end thereof, said mounting seat has a bottom part formed with a second insert hole, a lateral side formed with a vertical second insert slot extending through its lower end thereof, said first electric connection plate having a first end formed with said contact point and located within said first chamber and a second end extending through said second insert hole in said mounting seat, said first insert hole in said bottom seat for electrically connecting with the first wire, said first insulated member extending upward from a bottom side of said first chamber so as to be located between said first end of said first electric connection plate and said one of said first pivot elements, said second electric connection plate having a first end formed with said contact point and located within said second chamber and a second end extending through said vertical second insert slot in said mounting seat, said vertical first insert slot in said bottom seat for electrically connecting with the second wire, said second insulated member extending upward from a bottom side of said second chamber so as to be located between said first end of said second electric connection plate and said one of said second pivot elements.

10. The safety socket according to claim 1, wherein said mounting seat has a bottom part formed with two fixing posts, said first conductive plate has a connection portion interconnecting said first and second ends of said first conductive plate and formed with a positioning hole permitting extension of one of said fixing posts, said second conductive plate has a connection portion interconnecting said first and second ends of said second conductive plate and formed with a positioning hole permitting extension of another one of said fixing posts, wherein, said connection portion of said first conductive plate encircles and is spaced apart from said connection portion of said second conductive plate.

11. The safety socket according to claim 2, wherein said cover body is further formed with two through holes, the safety socket further comprising an On-and-Off switch device disposed on said mounting seat and including a plate member, a third spring disposed between a bottom part of said plate member and a bottom part of said mounting seat, a first switch and a second switch mounted on a top part of said plate member in such a manner to extend through said two through holes in said cover body, wherein, insertion of two terminals of the plug respectively into said first and second plug holes in said cover body results in causing downward movement of said first and second switches, which, in turn, causes movement of said plate member downward so as to compress said third spring such that said first and second switches respectively and electrically contact with said first and second conduction plates, thereby establishing electrical connection among said first and second electric connection plates, said first and second conductive plates, one of said first pivot elements and one of said second pivot elements, said first and second switches and said terminals of the plug; wherein, removal of said two terminals of the plug respectively from said first and second plug holes in said cover body results in upward movement of said plate member due to restoration force of said third spring, which, in turn, causes upward movement of said first and second switches and separating said first and second conductive plates such that said first and second electric connection plates, said first and second insulated members, said two first pivot elements, said two second pivot elements, said first and second ends of said first and second connective plates are disconnected electrically from said first and second switches.

* * * * *